US011258203B2

(12) United States Patent
Hosoda

(10) Patent No.: US 11,258,203 B2
(45) Date of Patent: Feb. 22, 2022

(54) CONNECTOR DEVICE

(71) Applicant: HIROSE ELECTRIC CO., LTD., Kanagawa (JP)

(72) Inventor: Shohei Hosoda, Kanagawa (JP)

(73) Assignee: HIROSE ELECTRIC CO., LTD., Kanagawa (JP)

( * ) Notice: Subject to any disclaimer, the term of this patent is extended or adjusted under 35 U.S.C. 154(b) by 61 days.

(21) Appl. No.: 16/999,148

(22) Filed: Aug. 21, 2020

(65) Prior Publication Data

US 2021/0066854 A1 Mar. 4, 2021

(30) Foreign Application Priority Data

Aug. 27, 2019 (JP) ..... JP2019-154422

(51) Int. Cl.

| | |
|---|---|
| ***H01R 13/641*** | (2006.01) |
| ***H01R 13/502*** | (2006.01) |
| ***H01R 13/24*** | (2006.01) |
| ***H01R 12/71*** | (2011.01) |
| ***H01R 13/11*** | (2006.01) |
| *H01R 107/00* | (2006.01) |

(52) U.S. Cl.

CPC ..... *H01R 13/641* (2013.01); *H01R 12/716* (2013.01); *H01R 13/11* (2013.01); *H01R 13/2407* (2013.01); *H01R 13/502* (2013.01); *H01R 2107/00* (2013.01)

(58) Field of Classification Search

CPC .. H01R 13/641; H01R 13/11; H01R 13/2407; H01R 13/502; H01R 13/6597; H01R 13/46; H01R 13/465; H01R 13/66; H01R 12/716; H01R 12/73; H01R 12/70; H01R 2107/00

See application file for complete search history.

(56) References Cited

U.S. PATENT DOCUMENTS 8,961,215 B2 * 2/2015 Hasegawa ..... H01R 12/73 439/346
9,362,637 B2 * 6/2016 Hasegawa ..... H01R 12/716
(Continued)

FOREIGN PATENT DOCUMENTS

JP 2006-344418 A 12/2006

*Primary Examiner* — Abdullah A Riyami
*Assistant Examiner* — Nader J Alhawamdeh
(74) *Attorney, Agent, or Firm* — Rankin, Hill & Clark LLP

(57) ABSTRACT

Provided is a connector device which includes: a first connector; and a second connector. In the connector device, the first connector includes a first housing and a first terminal provided in the first housing, the second connector includes a second housing and a second terminal and an observation member provided in the second housing, the observation member includes a contact portion and an observation portion, the contact portion is configured to contact the first connector when at least part of the first connector is inserted into a predetermined portion of the second housing, and the observation portion is provided observable from an outside of the second connector at least either one of before or after connection between the first terminal and the second terminal, and is configured such that an observation state of the observation portion from the outside of the second connector changes in response to contact between the first connector and the contact portion.

19 Claims, 16 Drawing Sheets

(56) References Cited

U.S. PATENT DOCUMENTS

| | | | | |
|---|---|---|---|---|
| 9,391,398 | B2 * | 7/2016 | Omodachi | H01R 12/716 |
| 10,003,146 | B2 * | 6/2018 | Doi | H01R 13/502 |
| 10,396,484 | B2 * | 8/2019 | Chen | H01R 12/7088 |
| 10,804,647 | B2 * | 10/2020 | Kitagawa | H01R 13/629 |
| 10,910,745 | B2 * | 2/2021 | Hosoda | H01R 13/631 |
| 10,950,980 | B2 * | 3/2021 | Sunaga | H01R 13/6591 |
| 2013/0137281 | A1 * | 5/2013 | Hirakawa | H01R 12/79 439/65 |
| 2014/0364003 | A1 * | 12/2014 | Yunoki | H01R 12/716 439/374 |
| 2018/0358729 | A1 * | 12/2018 | Chen | H01R 13/20 |
| 2020/0235506 | A1 * | 7/2020 | Hosoda | H01R 12/716 |
| 2021/0066854 | A1 * | 3/2021 | Hosoda | H01R 13/2407 |

* cited by examiner

CONNECTOR DEVICE

CROSS-REFERENCE TO RELATED APPLICATION

This application claims priority from Japanese Patent Application No. 2019-154422 filed with the Japan Patent Office on Aug. 27, 2019, the entire content of which is hereby incorporated by reference.

1. Technical Field

The present disclosure relates to a connector device.

2. Related Art

At an assembly step for mobile equipment, industrial equipment, and various other types of equipment, B-to-B connectors for connecting substrates have been generally broadly used. As a result, complete and reliable automation of connection between the connectors, i.e., connection between terminals provided at the connectors, not by a human hand but by a machine has been a typical challenge. That is, implementation of complete robot fitting has been the typical challenge. In recent years, due to an increasing connector demand, a labor cost increase, a demand for cost reduction, connector damage due to a worker's operation error, and other various factors, it has been urgent that the above-described challenge is solved. For automation of terminal connection, it is important for the connectors to be connected to each other to correctly face each other as disclosed in, e.g., JP-A-2006-344418. However, the most important point is to reliably perform terminal connection and provide some kind of technique of easily and reliably checking terminal connection.

For example, the technique of directly checking terminal connection by continuity inspection, i.e., actual application of an electrical signal to between terminals has been employed as the typical technique of checking connection between the terminals. In addition, there is also the technique of performing indirect checking based on some kind of measurement value. Examples include 1) the technique of checking terminal connection by height control, i.e., based on a measurement value of a connector position measured using a position sensor from a lateral direction of a connector, 2) the technique of checking terminal connection by stroke control, i.e., based on a measurement value of a distance between substances on which connectors are mounted, and 3) the technique of checking terminal connection by load control, i.e., based on a measurement value of a load applied upon connection of connectors.

SUMMARY

A connector device according to the present embodiment includes: a first connector; and a second connector. The first connector includes a first housing and a first terminal provided in the first housing, the second connector includes a second housing and a second terminal and an observation member provided in the second housing, the first connector and the second connector are configured such that when at least part of the first connector is inserted into a predetermined portion of the second housing, the first terminal and the second terminal are connected to each other, the observation member includes a contact portion and an observation portion, the contact portion is configured to contact the first connector when the at least part of the first connector is inserted into the predetermined portion of the second housing, and the observation portion is provided observable from an outside of the second connector at least either one of before or after connection between the first terminal and the second terminal, and is configured such that an observation state of the observation portion from the outside of the second connector changes in response to contact between the first connector and the contact portion.

DETAILED DESCRIPTION

Figure 1:
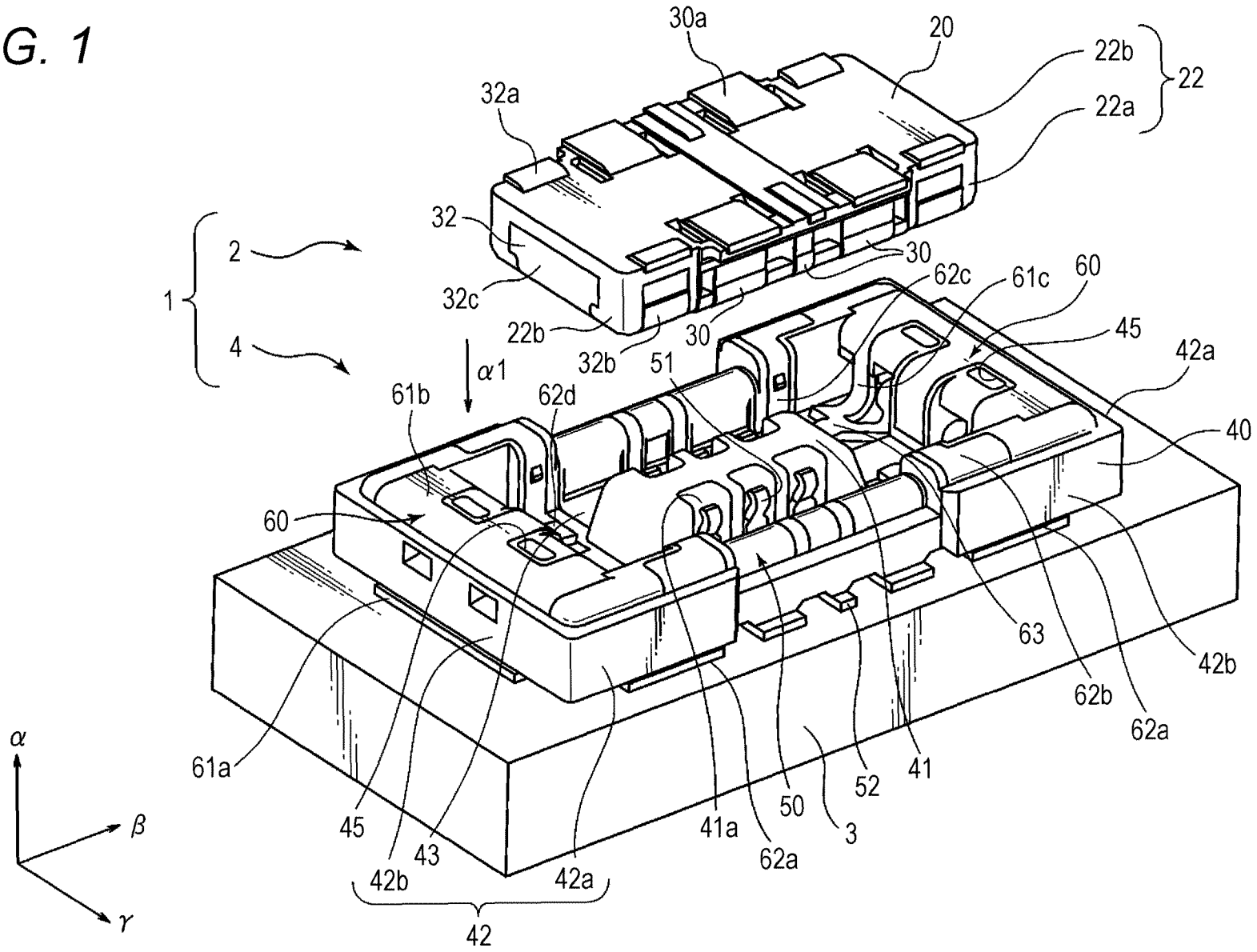
FIG. 1 is a perspective view showing one example of a connector device according to a first embodiment of the present disclosure together with peripheral members thereof.

In the following detailed description, for purpose of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

Any of the typical techniques described above as 1) to 3) is an indirect checking technique. That is, the typical techniques are neither intuitive nor direct. Moreover, problems such as a measurement error and low reliability are easily caused. For example, in the height control of 1) above, the tolerance of a height between substrates, such as a tolerance which might be caused due to, e.g., inclination upon fitting, a solder height, or a variation among the substrates, needs to be compensated. Specifically for a low-height connector, it is difficult to establish design. Moreover, in the stroke control of 2) above and the load control of 3) above, it might be difficult or impossible for a client to perform verification due to, e.g., warpage of a substrate or a housing. Further, a load sensor used in the load control of 3) above is general expensive. In addition, tendency shows that a load sensor facility is large. Moreover, in the techniques of 1) and 2) above, it is particularly impossible or difficult to use these techniques for all of multiple connectors densely arranged on substrates. On the other hand, the continuity inspection for checking terminal connection by actual application of the electrical signal to between the terminals is the technique of directly checking terminal connection. However, even in a case where terminal connection is incomplete, the electrical signal is applied. In this case, additional facility investment such as an inspection tool is necessary. Moreover, due to such a disadvantage, any of the techniques of 1) to 3) above is eventually used in combination in many cases.

An objective of the present disclosure is to provide a connector device for which the disadvantages in the above-described typical techniques have been solved. That is, the objective is to provide a connector device configured so that terminal connection can be intuitively, directly, easily, and reliably checked using the sense of sight. Further, the objective of the present disclosure is to provide a system and a method which can be used for such a connector device.

In order to solve the above-described problem, a connector device according to the present disclosure is configured to include: a first connector; and a second connector. The connector device is also configured such that the first connector includes a first housing and a first terminal provided in the first housing, the second connector includes a second housing and a second terminal and an observation member provided in the second housing, the first connector and the second connector are configured such that when at least part of the first connector is inserted into a predetermined portion of the second housing, the first terminal and the second terminal are connected to each other, the observation member includes a contact portion and an observation portion, the contact portion is configured to contact the first connector when the at least part of the first connector is inserted into the predetermined portion of the second housing, and the observation portion is provided observable from an outside of the second connector at least either one of before or after connection between the first terminal and the second terminal, and is configured such that an observation state of the observation portion from the outside of the second connector changes in response to contact between the first connector and the contact portion.

According to the connector device of this aspect, the observation member including the contact portion and the observation portion is provided in the housing (the second housing) of one connector (the second connector). Moreover, the observation state of the observation portion changes in response to contact between the contact portion and part of the partner housing (the first housing) of the partner connector (the first connector). Thus, terminal connection can be intuitively checked using the sense of sight. As a result, terminal connection can be easily and reliably checked.

The connector device according to one aspect of the present disclosure is characterized by a system and a method used for this device.

In the connector device of the above-described aspect, the observation state of the observation portion from the outside of the second connector may change such that the observation portion is observable from the outside of the second connector before connection and is not observable from the outside of the second connector in response to contact. Alternatively, the observation state of the observation portion from the outside of the second connector may change such that the observation portion is not observable from the outside of the second connector before connection and is observable from the outside of the second connector in response to contact.

Moreover, in the connector device of the above-described aspect, a change in the observation state preferably includes a change in at least any one of the position, the size, the shape, the pattern, or the color of the observation portion.

Further, the position of the observation portion with respect to the second connector may change in response to contact.

In addition, in the connector device of the above-described aspect, the contact portion and the observation portion may be coupled to each other. Moreover, the contact portion may be movable relative to the second connector by contact. Further, the position of the observation portion with respect to the second connector may change in response to movement of the contact portion.

In addition, the position of the observation portion with respect to the second connector may change at least in a longitudinal direction of the second housing perpendicular to the direction of connection between the first connector and the second connector.

Moreover, in the connector device of the above-described aspect, the contact portion may be positioned between the observation portion and the second terminal in the longitudinal direction.

Further, the observation portion is preferably provided at at least one end portion of the second housing in the longitudinal direction of the second housing perpendicular to the direction of connection between the first connector and the second connector. In this case, the observation portions are apart from each other in a transverse direction of the second housing perpendicular to the connection direction.

In addition, the observation member is preferably provided at each of all end portions of the second housing in the longitudinal direction of the second housing perpendicular to the direction of connection between the first connector and the second connector.

Moreover, in the connector device of the above-described aspect, the observation member may include an elastic member. Further, the contact portion may include an elastic piece as part of the elastic member.

In the connector device of the above-described aspect, the observation member may further include a mounting portion and a covering portion covering a peripheral wall of the first housing.

According to the present disclosure, the connector device configured so that terminal connection can be intuitively, directly, easily, and reliably checked using the sense of sight. Moreover, the system and the method which can be used for such a connector device is provided.

Hereinafter, a connector device according to a first embodiment of the present disclosure will be described with reference to the attached drawings. For the sake of convenience in description, only preferred embodiments will be described. Needless to say, description below is not intended to limit aspects of the present disclosure.

First Embodiment

FIG. 1 is a perspective view showing one example of a connector device 1 according to the present disclosure together with peripheral members thereof. For the sake of simplicity, only a circuit board 3 will be described herein as a peripheral member. The connector device 1 includes a plug connector (a first connector) 2 and a receptacle connector (a second connector) 4. The plug connector 2 is mounted on a circuit board different from the circuit board on which the receptacle connector 4 is mounted. The plug connector 2 and the receptacle connector 4 mounted on the circuit boards can be connected, e.g., fitted, to each other along a connection direction "α1." Moreover, the plug connector 2 and the receptacle connector 4 have symmetrical shapes in a longitudinal direction "β" perpendicular to the connection direction "α1" and a transverse direction "γ" perpendicular to both of the connection direction "α1" and the longitudinal direction "β."

Figure 2:
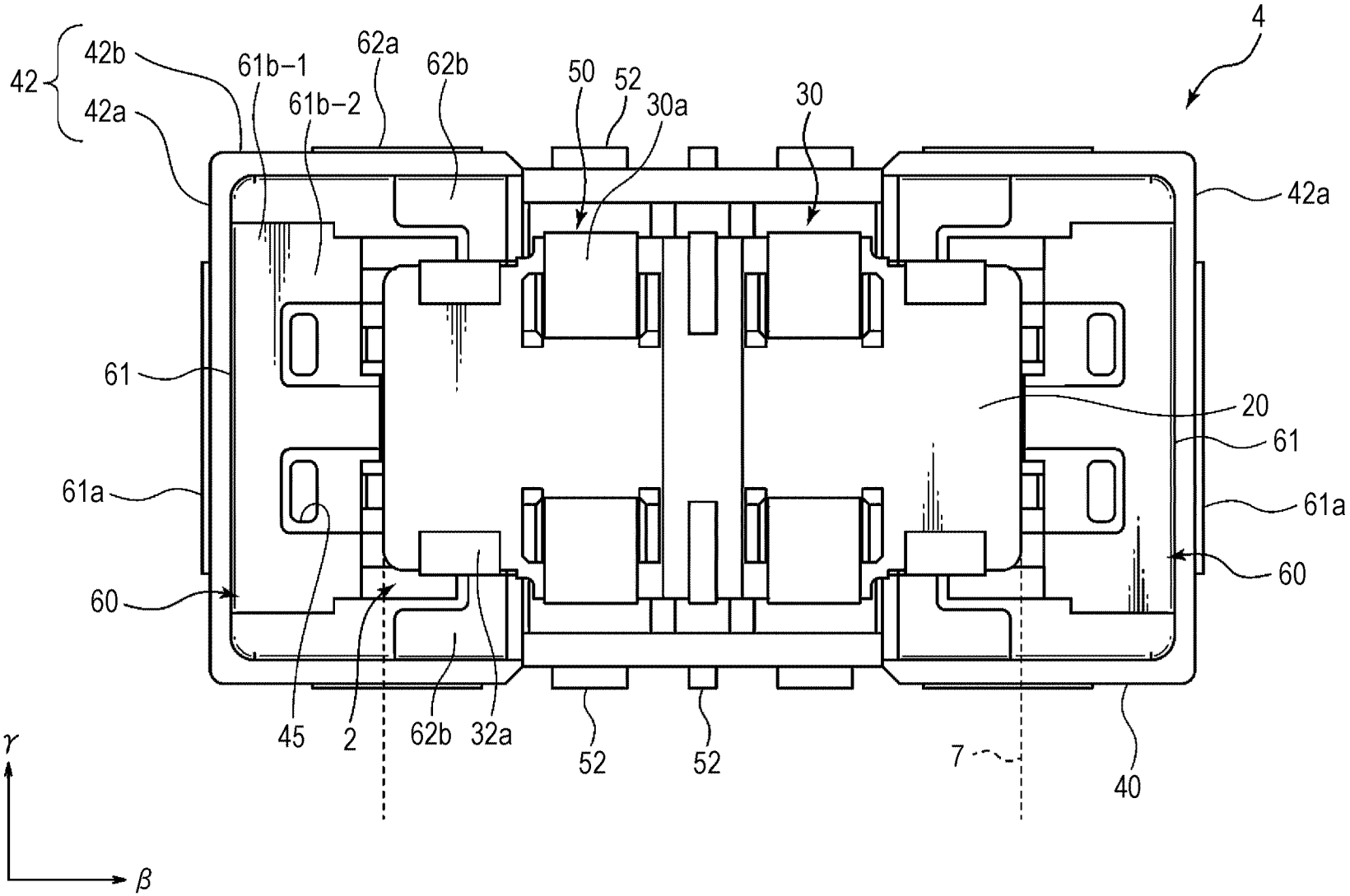
FIG. 2 is a plan view showing a plug connector and a receptacle connector used in the first embodiment of the present disclosure after these connectors have been fitted to each other.

FIG. 2 shows a plan view of the plug connector 2 and the receptacle connector 4 after these connectors have been fitted to each other. This figure shows, as a peripheral member, a conductive member 7 such as a flexible cable, a flexible board, or a circuit board in a simple manner. The plug connector 2 is used with the plug connector 2 being fixed to one end of the conductive member 7.

The plug connector 2 is fixed to the conductive member 7 having flexibility. Thus, the plug connector 2 is relatively freely movable relative to the receptacle connector 4. On the other hand, the receptacle connector 4 is used with the receptacle connector 4 being fixed to the circuit board 3. Note that on the contrary, the plug connector 2 mounted on the circuit board and the receptacle connector 4 fixed to the conductive member with the flexibility may be used. Needless to say, both of the plug connector 2 and the receptacle connector 4 may be used with these connectors being fixed to the conductive member with the flexibility.

The plug connector 2 includes a plug housing (a first housing) 20, plug terminals (first terminals) 30, and reinforcing metal fittings 32, the plug terminals 30 and the reinforcing metal fittings 32 being provided in the plug housing 20.

For reducing the height of the connector device, the plug housing 20 is formed as a flat member. The plug housing 20 has a peripheral wall 22 in a rectangular frame shape as viewed in plane. The peripheral wall 22 has a height in a direction "α" along the connection direction "α1." Moreover, the peripheral wall 22 includes two side walls 22*a* extending along the longitudinal direction "β" and two end walls 22*b* extending along the transverse direction "γ." Although not clearly shown in FIG. 2, a rectangular recess surrounded by the peripheral wall 22 is provided at the center as viewed in plane. An island portion 41 of the receptacle connector 4 is fitted in such a recess.

The multiple plug terminals 30 are arrayed adjacent to each other in the longitudinal direction "β." Part of the plug terminals 30 is exposed at the side walls 22*a*. In this embodiment, three plug terminals 30 are provided. The plug terminal 30 is fixed to the conductive member 7 (see FIG. 2) at a mounting portion 30*a*. As in, e.g., a general flexible cable, the conductive member 7 extends in a band shape from each type of equipment. Specifically in the first embodiment, a connection state is checked through observation windows 45 provided at the receptacle connector 4. Due to such a configuration, the width of the conductive member 7 is preferably set to such a size that the observation windows 45 are not closed, as clearly shown in FIG. 2. In other words, the width of the conductive member 7 is set to a size substantially equal to or smaller than the width of the plug connector 2 in the longitudinal direction "β." Note that it is natural to set such dimensions in a normal connector device. Thus, no special design is necessary for such dimension settings.

The single reinforcing metal fitting 32 is provided at each of end portions of the plug housing 20 in the longitudinal direction "β." At each end portion, portions 32*b*, 32*c* of the reinforcing metal fitting 32 are each exposed at the side wall 22*a* and the end wall 22*b* of the plug housing 20. As in the plug terminal 30, the reinforcing metal fitting 32 is fixed to the conductive member at a mounting portion 32*a*.

Figure 3:
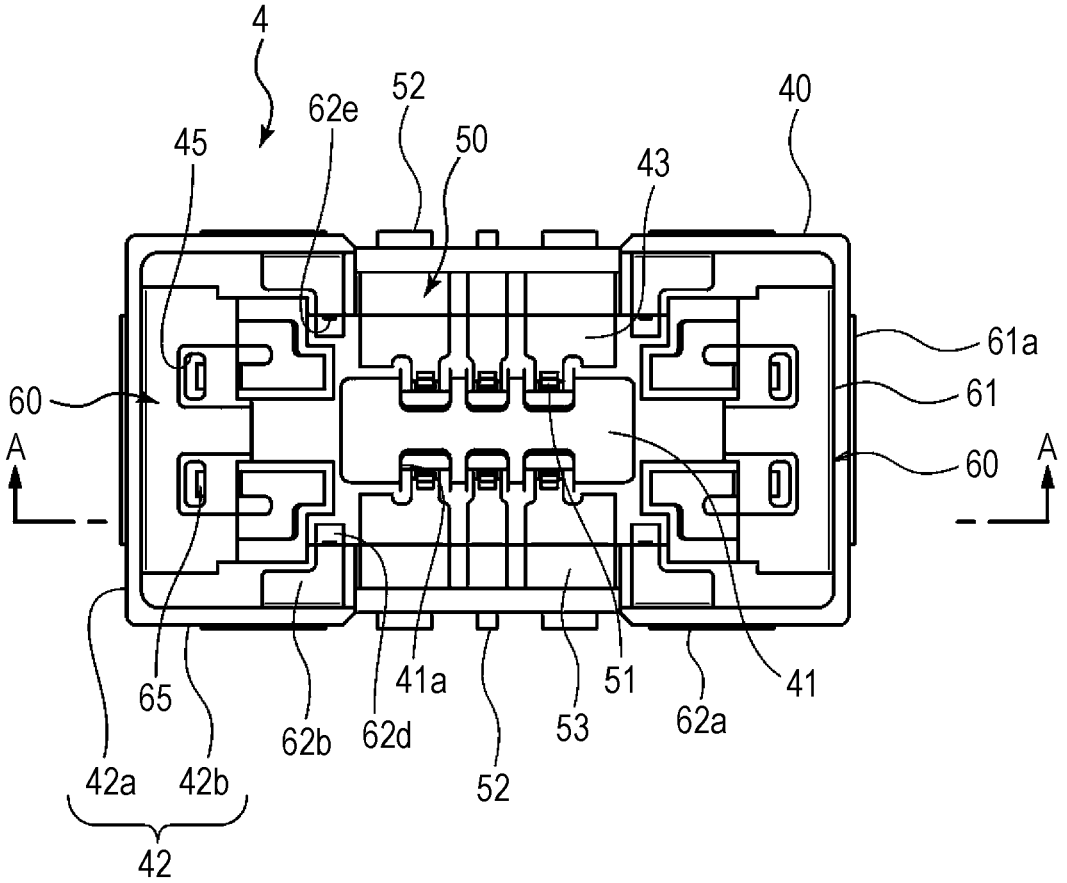
FIG. 3 is a plan view of the receptacle connector used in the first embodiment of the present disclosure.
Figure 4:
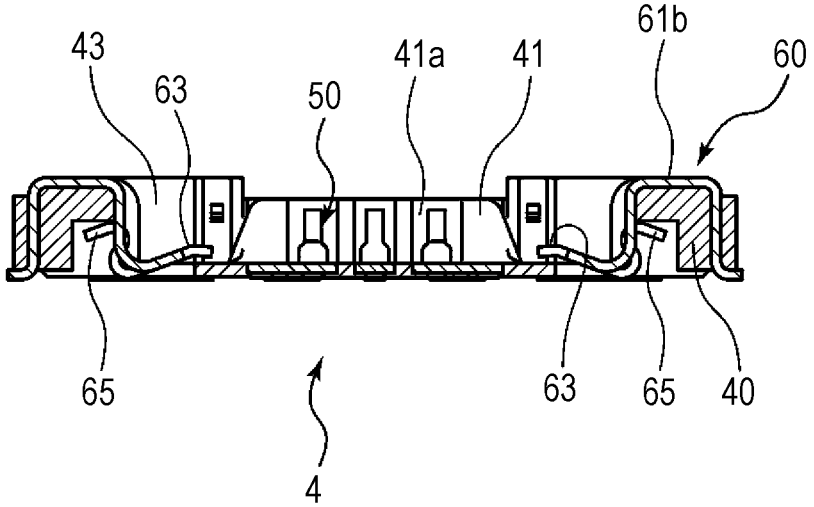
FIG. 4 is an A-A sectional view of FIG. 3.

FIG. 3 is a plan view of the receptacle connector 4. FIG. 4 is an A-A sectional view of FIG. 3. The receptacle connector 4 includes a receptacle housing (a second housing) 40, receptacle terminals (second terminals) 50, and observation members 60, the receptacle terminals 50 and the observation members 60 being provided in the receptacle housing 40. The receptacle terminals 50 and the observation members 60 are molded (insert-molded) integrally with the receptacle housing 40.

As in the plug housing 20, the receptacle housing 40 is formed as a flat member. The receptacle housing 40 has a peripheral wall 42 in a rectangular frame shape as viewed in plane. The peripheral wall 42 has a height in the direction "α" along the connection direction "α1." Moreover, the peripheral wall 42 includes two side walls 42*a* extending along the longitudinal direction "β" and two end walls 42*b* extending along the transverse direction "γ." At the center as viewed in plane, the substantially-rectangular island portion 41 having the substantially same height as that of the peripheral wall 42 in the direction "α" along the connection direction "α1" and surrounded by the peripheral wall 42 is provided. A fitting recessed portion 43 in a rectangular frame shape as viewed in plane is formed between the island portion 41 and the peripheral wall 42. Contact portions 51 of the receptacle terminals 50 and peripheral portions thereof are arranged in terminal housing grooves 41*a* provided at the island portion 41. The contact portion 51 protrudes to a certain extent from the terminal housing groove 41*a* to the outside, and is elastically displaceable in the transverse direction "γ."

The multiple receptacle terminals 50 are arrayed adjacent to each other in the longitudinal direction "β." Part of the receptacle terminals 50 is exposed at the side walls 42*a*. In this embodiment, three receptacle terminals 50 are provided.

The receptacle terminal 50 is, at a mounting portion 52, fixed to the circuit board 3 by soldering.

The single observation member 60 is provided at each of end portions of the receptacle housing 40 in the longitudinal direction "β." At each of the side walls 42*a* and the end walls 42*b* of the receptacle housing 40, part of the observation member 60 is exposed. As in the receptacle terminal 50, the observation member 60 is soldered to the circuit board 3 at mounting portions 61*a*, 62*a*.

Upon fitting between the plug connector 2 and the receptacle connector 4, the peripheral wall 22 of the plug connector 2 is, along the connection direction "α1," inserted into the fitting recessed portion 43 of the receptacle connector 4. At the same time, the island portion 41 of the receptacle connector 4 is, along the connection direction "α1," inserted into the rectangular center recess (not shown) surrounded by the peripheral wall 22 of the plug connector 2. By such insertion, the plug terminals 30 provided at the plug connector 2 and the receptacle terminals 50 provided at the receptacle connector 4 are connected to each other.

With the observation members 60, connection among the plug terminals 30 and the receptacle terminals 50 can be intuitively and directly checked using the sense of sight. In the first embodiment, the connection state can be checked through the observation windows 45 communicated with through-holes provided at the receptacle housing 40.

One example of checking of the connection state will be described with reference to FIGS. 2 and 3.

FIG. 3 shows the receptacle connector 4 before fitting between the plug connector 2 and the receptacle connector 4, i.e., before connection among the plug terminals 30 and the receptacle terminals 50. In this state, a user can check part (observation portions 65) of the observation members 60 from a predetermined position outside the receptacle connector 4 through the observation windows 45 provided at the receptacle housing 40.

On the other hand, FIG. 2 shows the plug connector 2 and the receptacle connector 4 after fitting between the plug connector 2 and the receptacle connector 4, i.e., connection among the plug terminals 30 and the receptacle terminals 50. In this state, the user can no longer check part (the observation portions 65) of the observation members 60 from at least the above-described predetermined position outside the receptacle connector 4.

As described above, according to the present configuration, connection among the plug terminals 30 and the receptacle terminals 50 can be intuitively and directly checked using the sense of sight according to the presence or absence of the observation portion 65 at a predetermined position corresponding to the observation window 45. Note that the presence or absence of the observation portion 65 may be checked using an image recognition technique using a camera. Specifically, an image recognition device is preferably used for a small connector device.

Figure 5A:
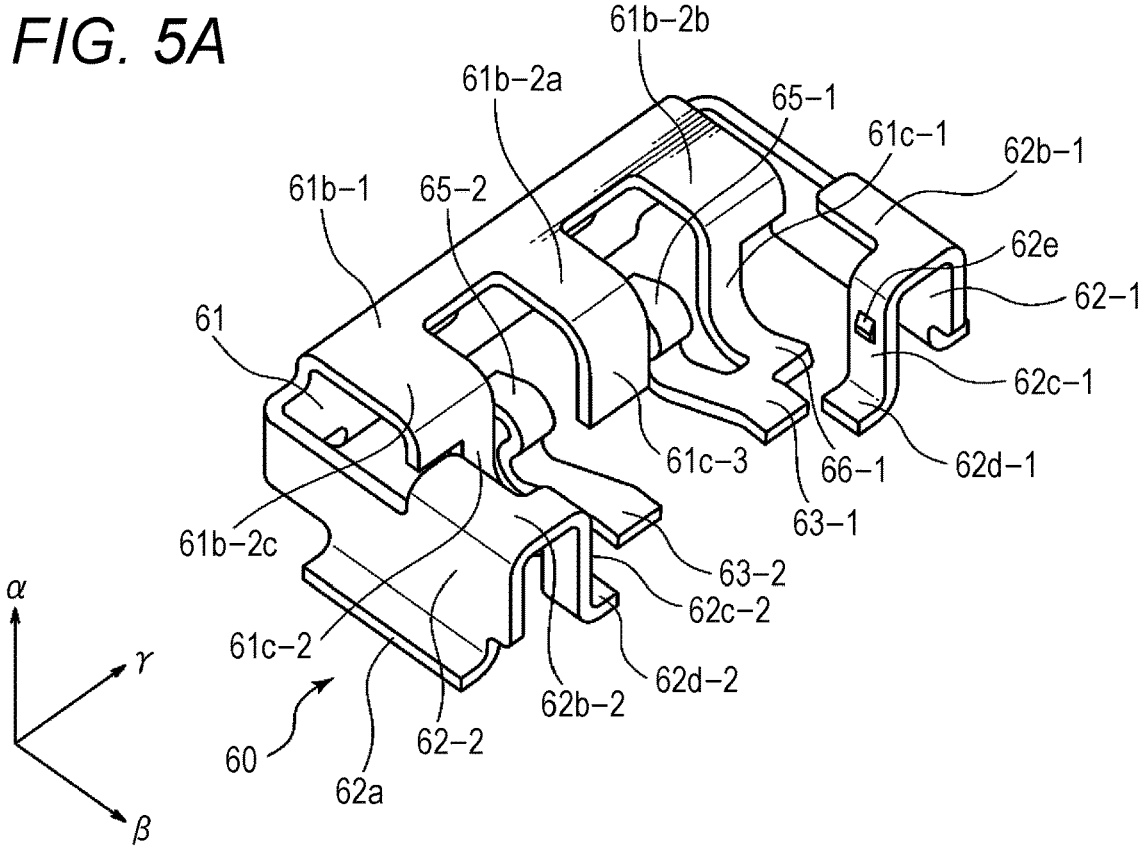
FIGS. 5A and 5B are perspective views of an observation member used in the first embodiment of the present disclosure.
Figure 5B:
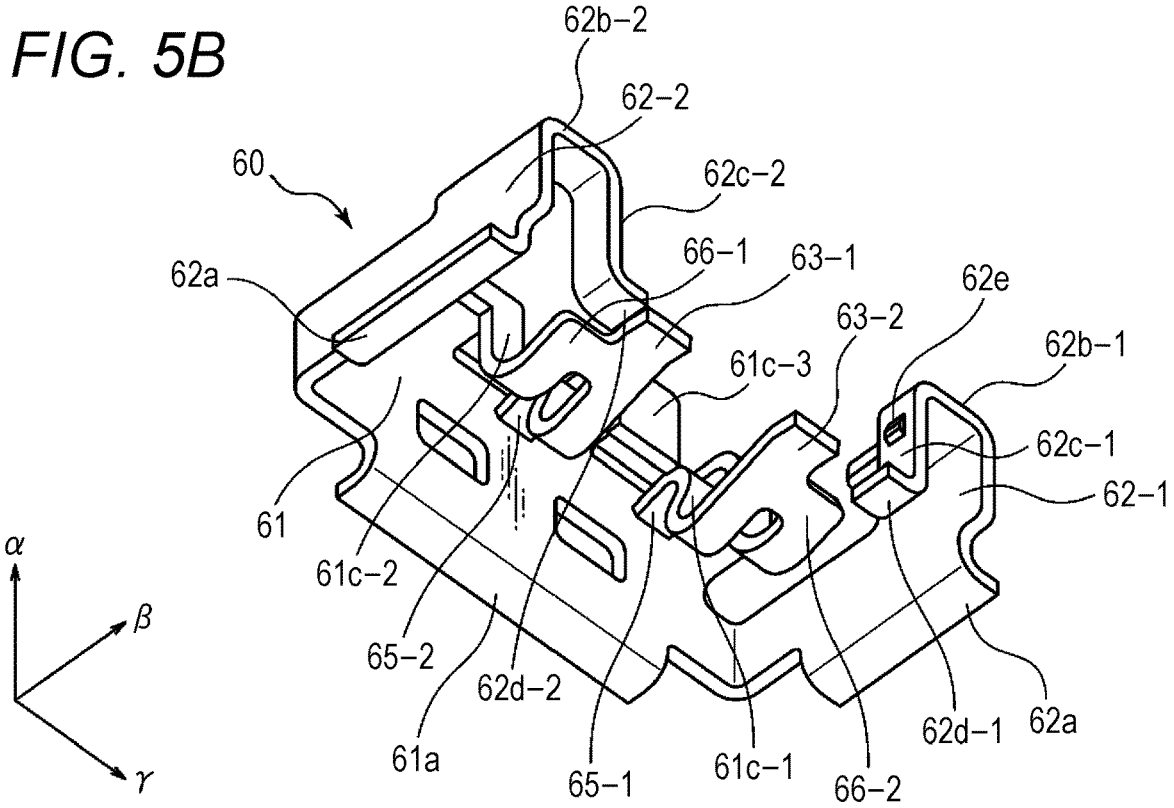

FIGS. 5A and 5B show perspective views of the observation member 60. FIG. 5A is the perspective view of the observation member 60 from above. FIG. 5B is the perspective view of the observation member 60 from below.

The observation member 60 is formed in such a manner that a single piece of metal plate having elasticity is punched and bent. The observation member 60 mainly includes a base 61, upper reinforcing portions 61*b* (61*b*-1, 61*b*-2*a*, 61*b*-2*b*, 61*b*-2*c*), intermediate coupling portions 61*c* (61*c*-1, 61*c*-2, 61*c*-3), elastic coupling portions 66-1, 66-2, contact portions 63 (63-1, 63-2), the observation portions 65 (65-1, 65-2), and side walls 62-1, 62-2. The side wall 62-1, 62-2 further includes upper reinforcing portions 62*b* (62*b*-1, 62*b*-2), inner wall reinforcing portions 62*c* (62*c*-1, 62*c*-2), and bottom reinforcing portions 62*d* (62*d*-1, 62*d*-2).

The base 61 is arranged on each of end portions of the receptacle connector 4 in the longitudinal direction "β." The base 61 is a larger plate-shaped body than other portions. The base 61 extends widely along the transverse direction "γ," and stands from the mounting portion 61*a* along the "α" direction. Note that the substantially entirety of the base 61 is embedded in the receptacle housing 40. Thus, only part of the base 61 can be actually recognized from the outside.

The upper reinforcing portions 61*b* are provided continuously to the base 61. Unlike the base 61, the upper reinforcing portions 61*b* are exposed to the outside of the receptacle housing 40. The base 61 has the function of covering a top portion of the end wall 42*b* of the receptacle housing 40 to protect the receptacle housing 40.

The upper reinforcing portions 61*b* include the first upper reinforcing portion 61*b*-1 and the second upper reinforcing portion 61*b*-2.

The first upper reinforcing portion 61*b*-1 has the substantially same width as that of the base 61 in the transverse direction "γ." Moreover, the first upper reinforcing portion 61*b*-1 extends inward of the receptacle housing 40 along the longitudinal direction "β." On the other hand, the second upper reinforcing portion 61*b*-2 is formed as three fixed pieces 61*b*-2*a*, 61*b*-2*b*, 61*b*-2*c*. Three fixed pieces are continuously branched from the first upper reinforcing portion 61*b*-1 in the same direction. Moreover, these fixed pieces are arranged along the transverse direction "γ," and have widths narrower than that of the first upper reinforcing portion 61*b*-1. These fixed pieces 61*b*-2*a*, 61*b*-2*b*, 61*b*-2*c* extend inward of the receptacle housing 40 along the longitudinal direction "β." The observation windows 45 (see FIGS. 2 and 3) are each arranged between the fixed piece 61*b*-2*a* and the fixed piece 61*b*-2*b* and between the fixed piece 61*b*-2*b* and the fixed piece 61*b*-2*c* in the transverse direction "γ."

Further, the intermediate coupling portions 61*c*-3, 61*c*-1, 61*c*-2 are provided. These intermediate coupling portions are each formed continuously to the fixed pieces 61*b*-2*a*, 61*b*-2*b*, 61*b*-2*c*, and are bent downward of the top portion of the end wall 42*b* along the direction "α" along the connection direction. Of these intermediate coupling portions 61*c*-3, 61*c*-1, 61*c*-2, the intermediate coupling portion 61*c*-3 positioned at the center in the transverse direction "γ" has the same width as that of the fixed piece 61*b*-2*a*. On the other hand, the intermediate coupling portions 61*c*-1, 61*c*-2 positioned at the end portions in the transverse direction "γ" each have smaller widths than those of the fixed pieces 61*b*-2*b*, 61*b*-2*c*. At an end portion of each of the intermediate coupling portions 61*c*-1, 61*c*-2, the elastic coupling portions 66-1, 66-2 bent to extend along a bottom surface of the fitting recessed portion 43 are provided. The contact portion 63-1, 63-2 and the observation portion 65-1, 65-2 are provided in this order through the elastic coupling portion 66-1, 66-2. The elastic coupling portion 66-1, 66-2 guides the observation portion 65-1, 65-2 in a direction opposite to the end portion of the intermediate coupling portion 61*c*-1, 61*c*-2 in the longitudinal direction "β." As clearly seen from FIG. 3 and the like, the contact portions 63-1, 63-2 are arranged in the fitting recessed portion 43 at positions among the observation portions 65-1, 65-2 and the receptacle terminals 50 in the longitudinal direction "β."

The contact portions 63-1, 63-2 are each provided at the end portions of the intermediate coupling portions 61*c*-1, 61*c*-2. These contact portions described herein are elastic pieces apart from each other in the transverse direction "γ." Each of the contact portions 63-1, 63-2 is positioned closer to the center than the elastic coupling portions 66-1, 66-2 are to in the transverse direction "γ." The contact portions 63-1, 63-2 can contact at least part of the plug connector 2 inserted into the fitting recessed portion 43 of the receptacle connector 4, such as the reinforcing metal fitting 32 provided at the plug connector 2 in the first embodiment. By such contact, the contact portions 63-1, 63-2 are movable relative to the receptacle connector 4.

The observation portions 65-1, 65-2 are each formed continuously from the contact portions 63-1, 63-2. These observation portions are apart from each other in the transverse direction "γ." Moreover, each of these observation portions is formed at an end portion of a piece extending outward of the receptacle housing 40 along the longitudinal direction "β." The observation portions 65-1, 65-2 according to the first embodiment are, for adjustment of an observation state, bent in a round shape to form a curved surface in the transverse direction "γ."

The side walls 62-1, 62-2 are two relatively-large plate-shaped bodies extending along the longitudinal direction "β." Each of these side walls is arranged at the end portion of the receptacle connector 4 in the transverse direction "γ." The side walls 62-1, 62-2 stand from mounting portions 62*a* along the "α" direction. Note that as in the base 61, the substantially entirety of the side walls 62-1, 62-2 is embedded in the receptacle housing 40. Thus, only part of the side walls 62-1, 62-2 can be actually recognized from the outside.

The upper reinforcing portions 62*b*-1, 62*b*-2 formed continuously to the side walls 62-1, 62-2 are each provided at end portions of the side walls 62-1, 62-2 in the longitudinal direction "β." Unlike the side walls 62-1, 62-2, the upper reinforcing portions 62*b*-1, 62*b*-2 are exposed to the outside of the receptacle housing 40. Thus, the upper reinforcing portions 62*b*-1, 62*b*-2 have the function of covering top portions of the side walls 42*a* of the receptacle housing 40 to protect the receptacle housing 40.

Further, the inner wall reinforcing portions 62*c*-1, 62*c*-2 are provided. These inner wall reinforcing portions are each bent downward of the top portions of the side walls 42*a* along the "α" direction in a state in which these inner wall reinforcing portions are formed continuously to the upper reinforcing portions 62*b*-1, 62*b*-2. Further, the bottom reinforcing portions 62*d*-1, 62*d*-2 making part of the fitting recessed portion 43 are each formed at end portions of the inner wall reinforcing portions 62*c*-1, 62*c*-2. Moreover, a locking protruding portion 62*e* that part of the reinforcing metal fitting 32 provided at the plug connector 2 can be locked is provided at an intermediate position of each of the inner wall reinforcing portions 62*c*-1, 62*c*-2.

Motion of the observation portion 65 described with reference to FIGS. 2 and 3 will be described again based on the structures of the contact portion 63 and the observation portion 65 with reference to FIGS. 6A, 6B, 7A, and 7B.

Figure 6B:
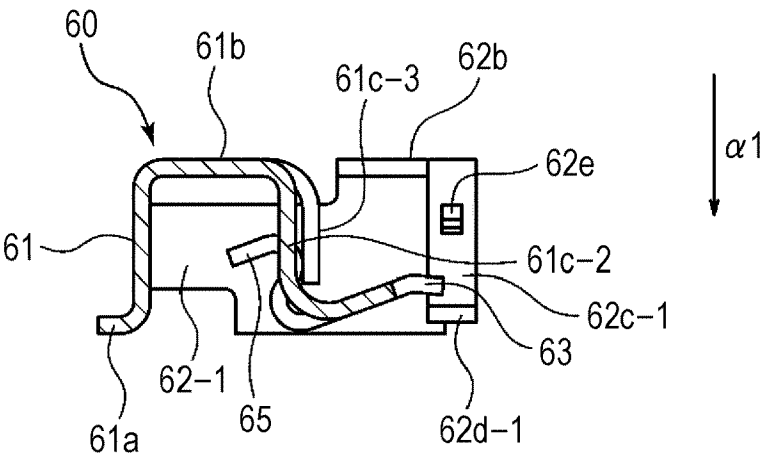
FIGS. 6A and 6B are views showing the plug connector and the receptacle connector used in the first embodiment of the present disclosure before these connectors are fitted to each other.
Figure 6A:
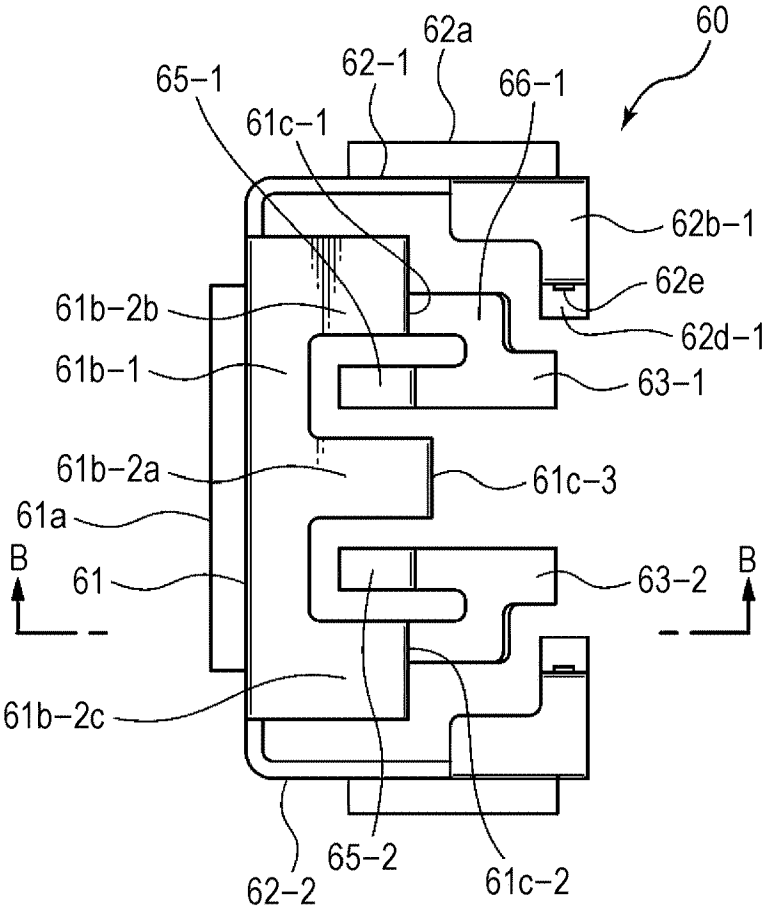

FIG. 6A shows the state of FIG. 3. That is, FIG. 6A is a plan view of the observation member 60 before fitting between the plug connector 2 and the receptacle connector 4, i.e., before connection among the plug terminals 30 and the receptacle terminals 50. FIG. 6B is a B-B sectional view of FIG. 6A.

Figure 7B:
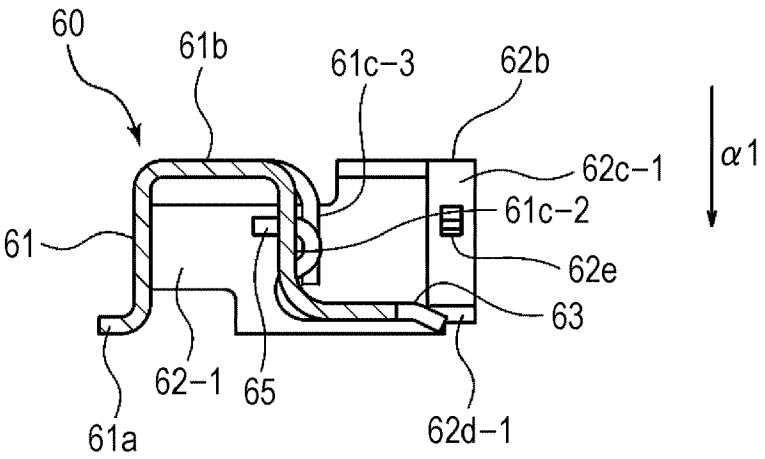
FIGS. 7A and 7B are views showing the plug connector and the receptacle connector used in the first embodiment of the present disclosure after these connectors have been fitted to each other.
Figure 7A:
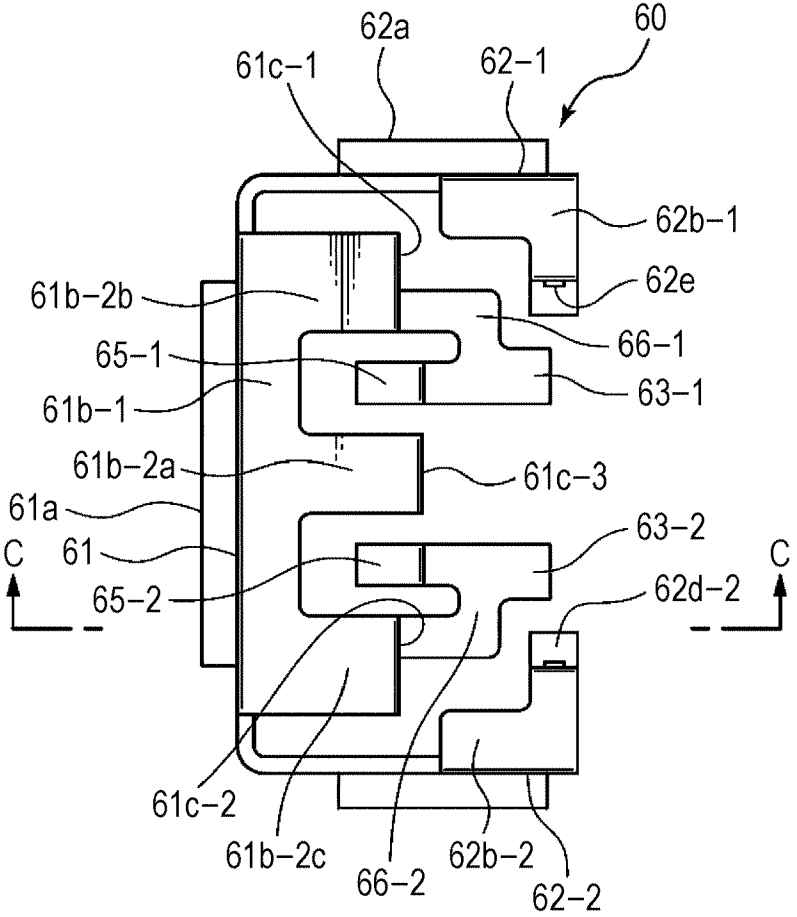

On the other hand, FIG. 7A shows the state of FIG. 2. That is, FIG. 7A is a plan view of the observation member 60 after fitting between the plug connector 2 and the receptacle connector 4, i.e., after connection among the plug terminals 30 and the receptacle terminals 50. FIG. 7B is a C-C sectional view of FIG. 7A.

As described above, the observation member 60 is formed in such a manner that the single piece of metal plate having the elasticity is punched and bent. Thus, the observation portions 65-1, 65-2 are each coupled to the contact portions 63-1, 63-2. With this configuration, when the state of FIGS. 6A and 6B changes to the state of FIGS. 7A and 7B, i.e., when the plug terminals 30 and the receptacle terminals 50 are connected to each other in fitting between the plug connector 2 and the receptacle connector 4, the contact portions 63-1, 63-2 move in contact with part (e.g., the reinforcing metal fittings 32) of the receptacle connector 4. More specifically, the contact portions 63-1, 63-2 are pushed to a bottom side along the "α" direction. In response, the positions of the observation portions 65-1, 65-2 with respect to the receptacle connector 4 change from positions shown in FIGS. 6A and 6B to positions shown in FIGS. 7A and 7B. Further, the observation portions 65-1, 65-2 are pushed upwardly, and at the same time, are drawn to the center side of the receptacle connector 4. As described above, the observation portions 65-1, 65-2 can be observed specifically through the observation windows 45 from the outside of the receptacle connector 4 at least either one of before or after connection among the plug terminals 30 and the receptacle terminals 50, i.e., before connection in the first embodiment. However, in response to movement of the contact portions 63-1, 63-2, the positions of the observation portions 65-1, 65-2 with respect to the receptacle connector 4 change in the longitudinal direction "β." Accordingly, the observation state of these observation portions also changes. As a result, as described with reference to FIGS. 2 and 3, the observation portions 65-1, 65-2 are out of sight from the observation windows 45, i.e., from the predetermined position outside the receptacle connector 4. That is, the observation portions 65-1, 65-2 cannot be observed.

Second Embodiment

A second embodiment will be described with reference to FIG. 8 to FIGS. 12A and 12B.

Figure 8:
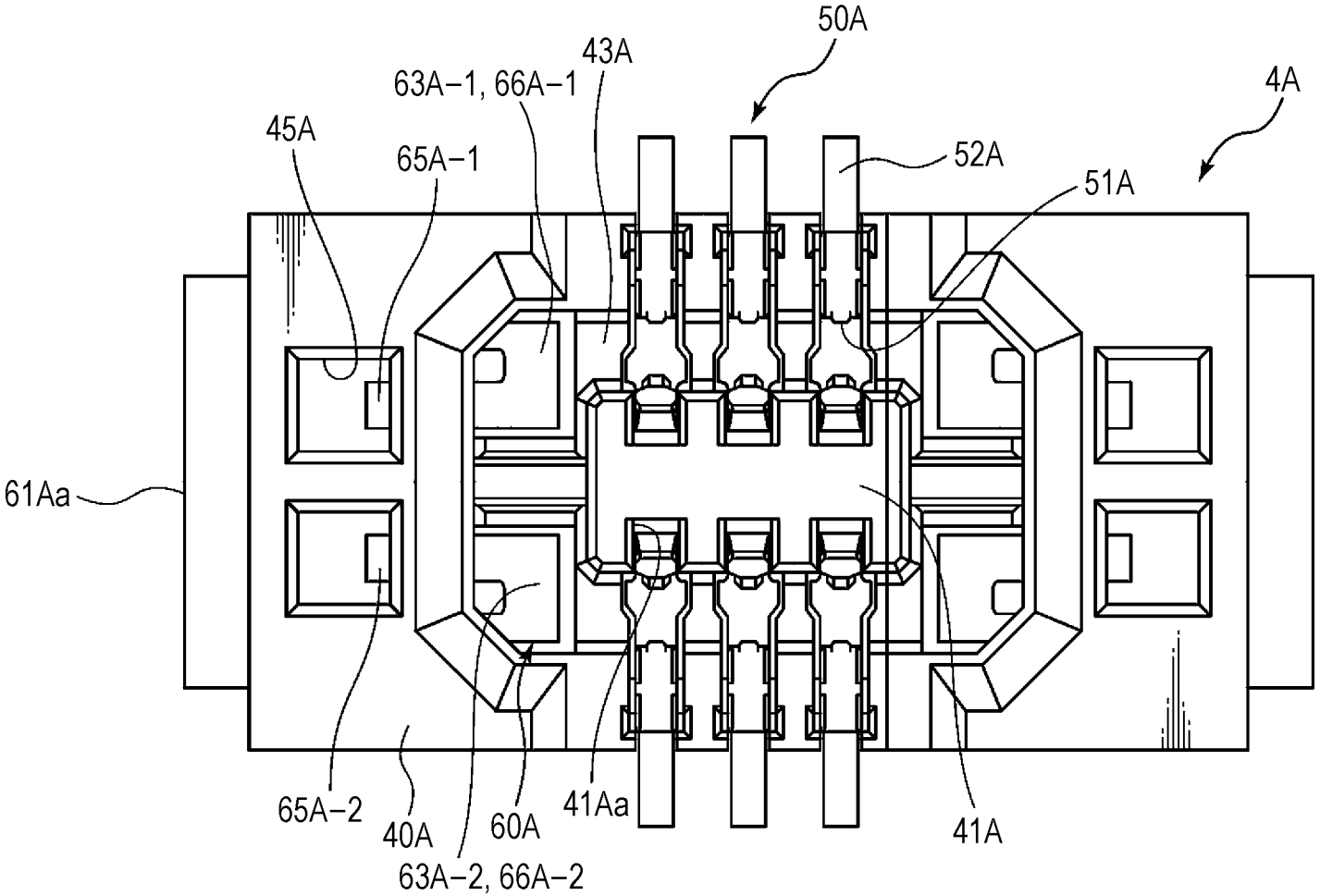
FIG. 8 is a plan view of a receptacle connector used in a second embodiment of the present disclosure.
Figure 9:
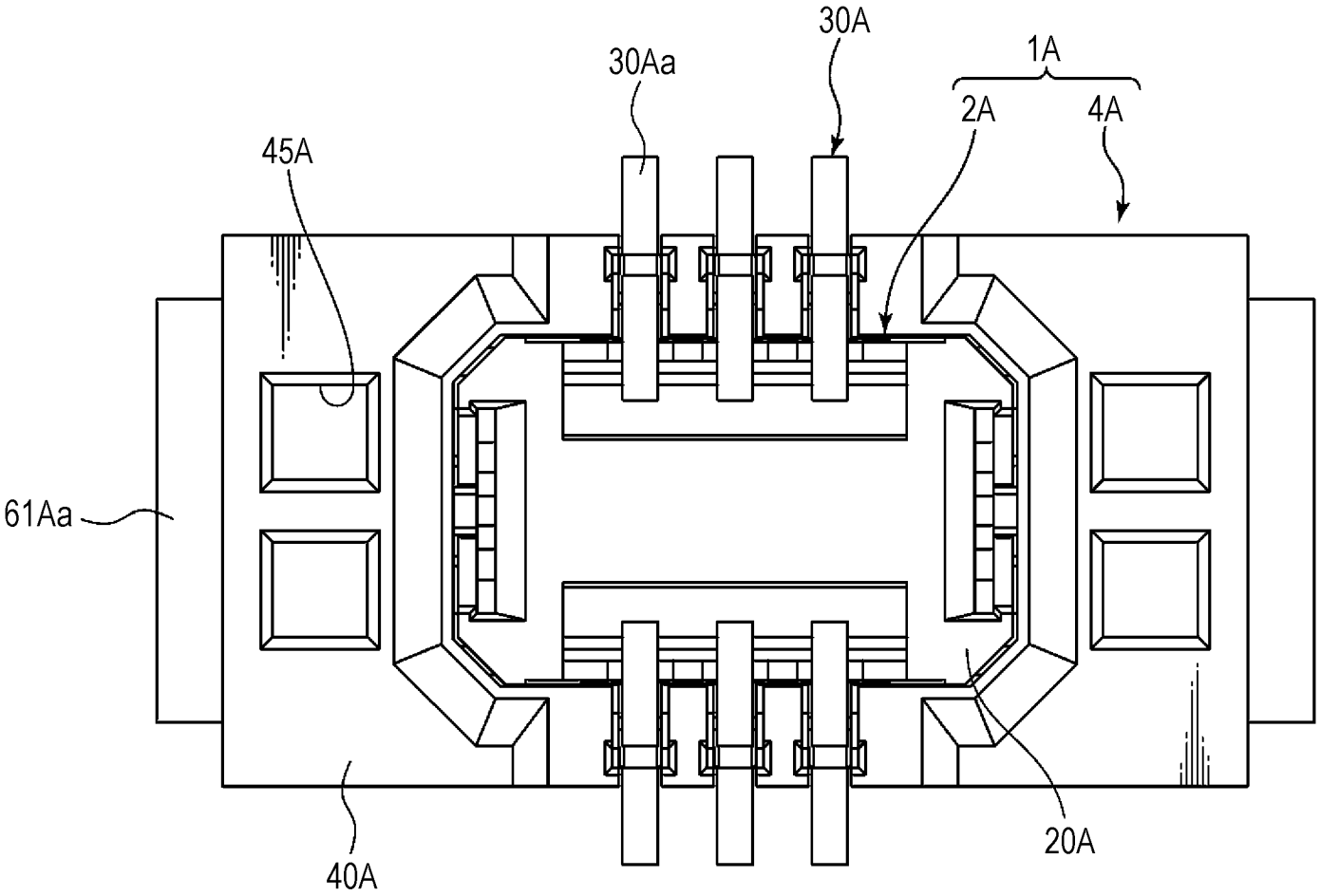
FIG. 9 is a plan view showing a plug connector and the receptacle connector used in the second embodiment of the present disclosure after these connectors have been fitted to each other.
Figure 10A:
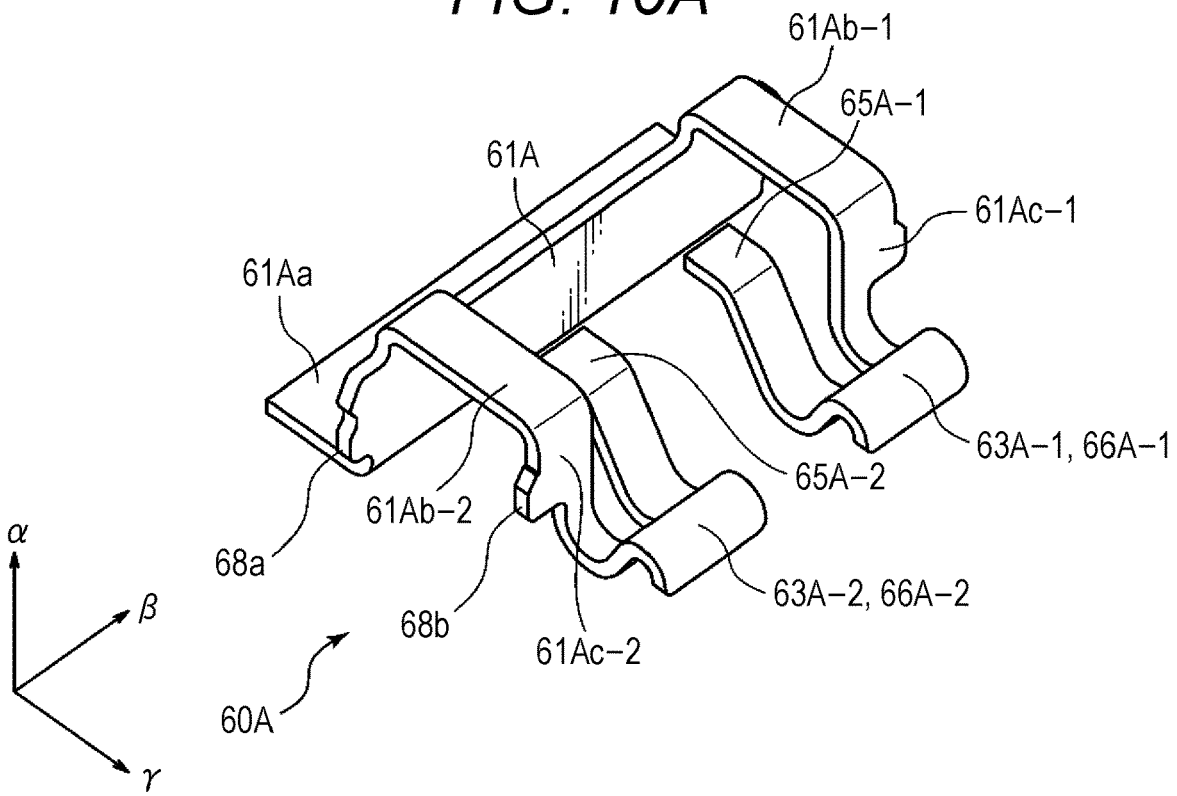
FIGS. 10A and 10B are perspective views of an observation member used in the second embodiment of the present disclosure.
Figure 10B:
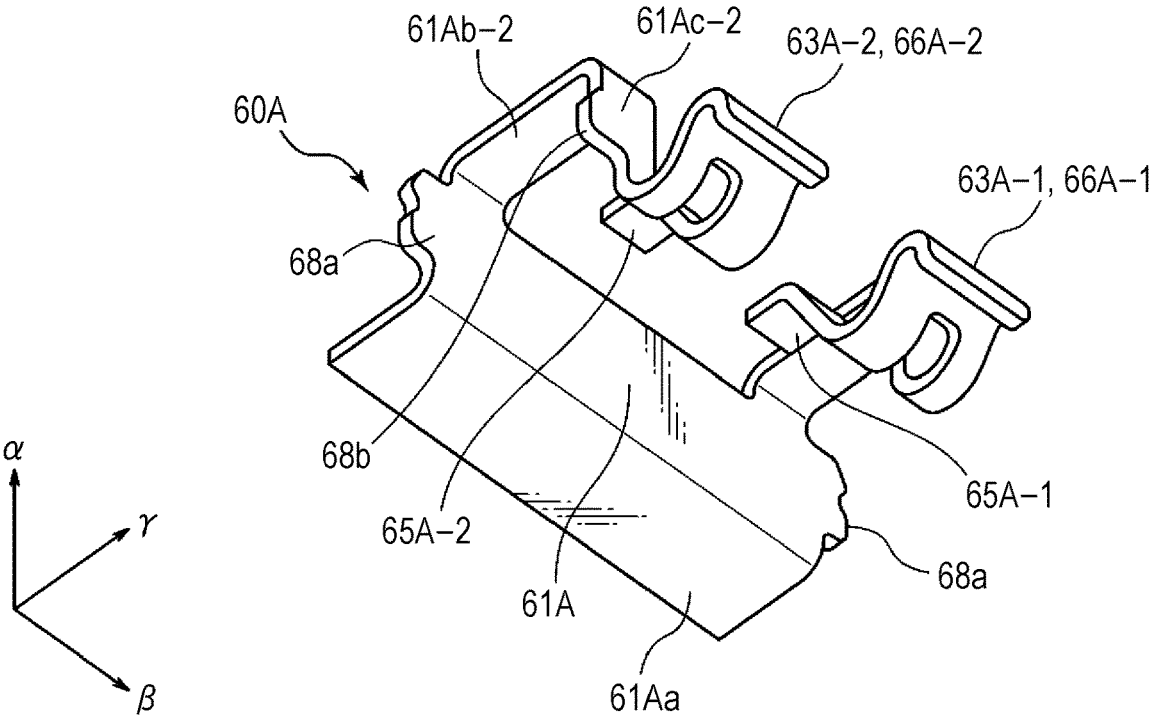

FIG. 8 is a plan view of a receptacle connector 4A. FIG. 9 is a plan view showing a plug connector 2A and the receptacle connector 4A after these connectors have been fitted to each other. FIGS. 10A and 10B are perspective views of an observation member 60A. FIG. 10A is the perspective view of the observation member 60A from above. FIG. 10B is the perspective view of the observation member 60A from below. FIGS. 8 to 10B each correspond to FIG. 3, FIG. 2, FIG. 5A, and FIG. 5B in the first embodiment.

Main differences between the second embodiment and the first embodiment are the method for attaching the observation member 60A to a receptacle housing 40A and the shape of the observation member 60A. Note that it can be assumed that a basic motion principle of the observation member 60A is similar to that of the first embodiment. Hereinafter, only the main differences from the first embodiment will be described. Note that the same reference numerals as those of the first embodiment are used with a character "A" to represent members corresponding to those of the first embodiment. Moreover, detailed description thereof will be omitted.

The observation member 60A mainly includes a base 61A, upper coupling portions 61Ab (61Ab-1, 61Ab-2), intermediate coupling portions 61Ac (61Ac-1, 61Ac-2) extending downwardly, contact portions 63A (63A-1, 63A-2), and observation portions 65A (65A-1, 65A-2). The observation member 60A is press-fitted and fixed to the receptacle housing 40A. When the observation member 60A is fixed to the receptacle housing 40A, only the contact portions 63A (63A-1, 63A-2) and the observation portions 65A (65A-1, 65A-2) may be mainly exposed to the outside.

The base 61A is a larger plate-shaped body than other portions, and is arranged on each of end portions of the receptacle connector 4A in the longitudinal direction "β." The base 61A extends widely along the transverse direction "γ," and stands from a mounting portion 61Aa along the "α" direction. At two end portions of the base 61A in the longitudinal direction "β," locking portions 68*a* for press-fitting and fixing the base 61A to the receptacle housing 40A are formed.

Two upper coupling portions 61Ab-1, 61Ab-2 formed continuously to the base 61A are provided. As in the base 61A, the upper coupling portions 61Ab-1, 61Ab-2 are incorporated into the receptacle housing 40A.

Further, the intermediate coupling portions 61Ac-1, 61Ac-2 are provided. These intermediate coupling portions are each formed continuously to the upper coupling portions 61Ab-1, 61Ab-2, and are bent downward of a top side along the "α" direction. As in the base 61A, locking portions 68*b* for press-fitting and fixing the base 61A to the receptacle housing 40A are formed at two end portions of the intermediate coupling portions 61Ac-1, 61Ac-2 in the longitudinal direction "β." At each of the end portions of the intermediate coupling portions 61Ac-1, 61Ac-2, the contact portion 63A-1, 63A-2 and the observation portion 65A-1, 65A-2 are provided in this order. The contact portions 63A-1, 63A-2 are formed widely in the transverse direction "γ." The contact portions 63A-1, 63A-2 as described herein have a function as the elastic coupling portions 66A-1, 66A-2 in the first embodiment.

The contact portions 63A-1, 63A-2 are each provided as elastic pieces at the end portions of the intermediate coupling portions 61Ac-1, 61Ac-2. Thus, these contact portions are apart from each other in the transverse direction "γ." The contact portions 63A-1, 63A-2 can contact at least part of the plug connector 2A inserted into a fitting recessed portion 43A of the receptacle connector 4A. By such contact, the contact portions 63A-1, 63A-2 are movable relative to the receptacle connector 4A.

Each of the observation portions 65A-1, 65A-2 is formed at an end portion of a piece extending outward of the receptacle housing 40A along the longitudinal direction "β." These pieces are each provided continuously to the contact portions 63A-1, 63A-2. Thus, these pieces are apart from each other in the transverse direction "γ." The observation portions 65A-1, 65A-2 according to the second embodiment are in a flat plate shape for adjustment of an observation state.

Motion of the observation portion 65A will be described based on the structures of the contact portion 63A and the observation portion 65A with reference to FIGS. 11A, 11B, 12A, and 12B. These figures each correspond to FIGS. 6A, 6B, 7A, and 7B in the first embodiment.

Figure 11A:
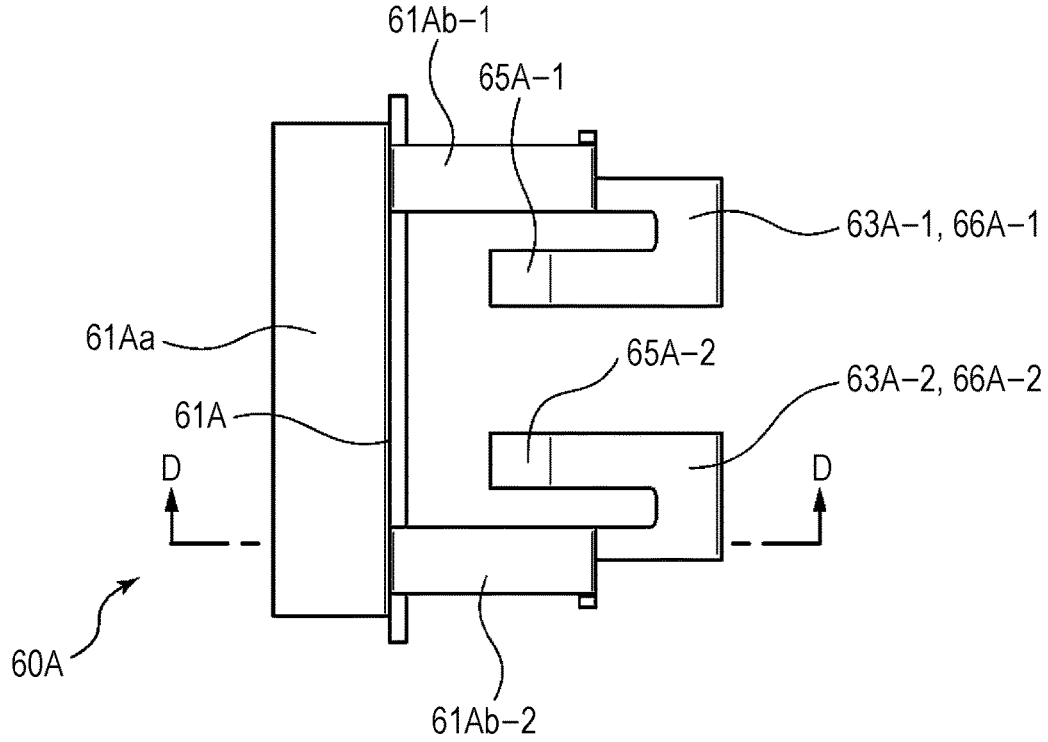
FIGS. 11A and 11B are views showing the plug connector and the receptacle connector used in the second embodiment of the present disclosure before these connectors are fitted to each other.
Figure 11B:
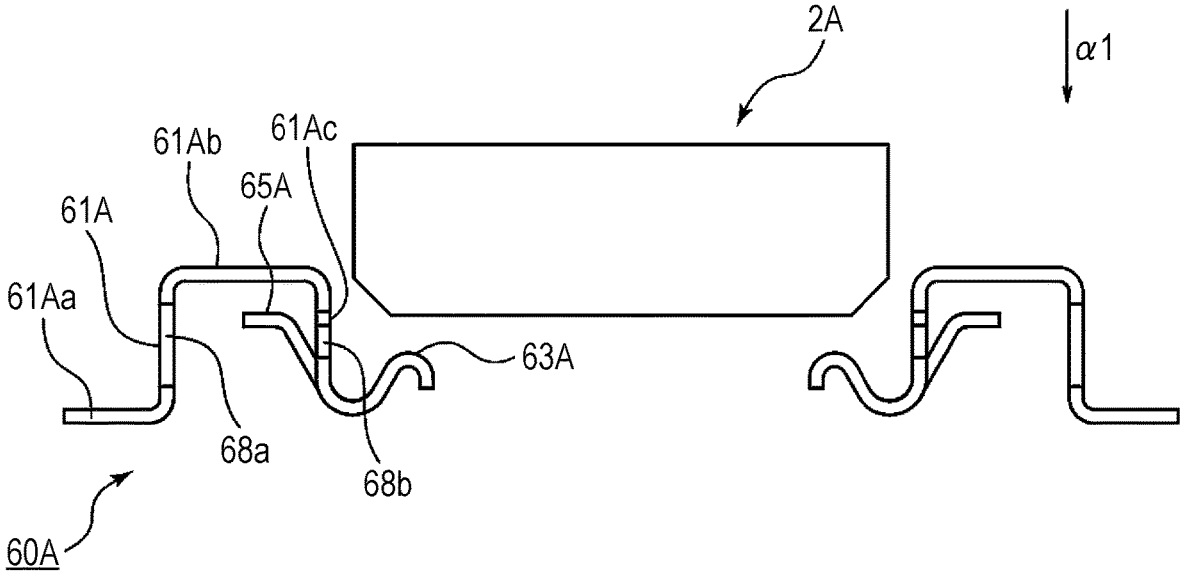

FIG. 11A shows the state of FIG. 8. That is, FIG. 11A is a plan view of the observation member 60A before fitting between the plug connector 2A and the receptacle connector 4A, i.e., before connection among plug terminals 30A and receptacle terminals 50A. FIG. 11B is a D-D sectional view of FIG. 11A.

Figure 12A:
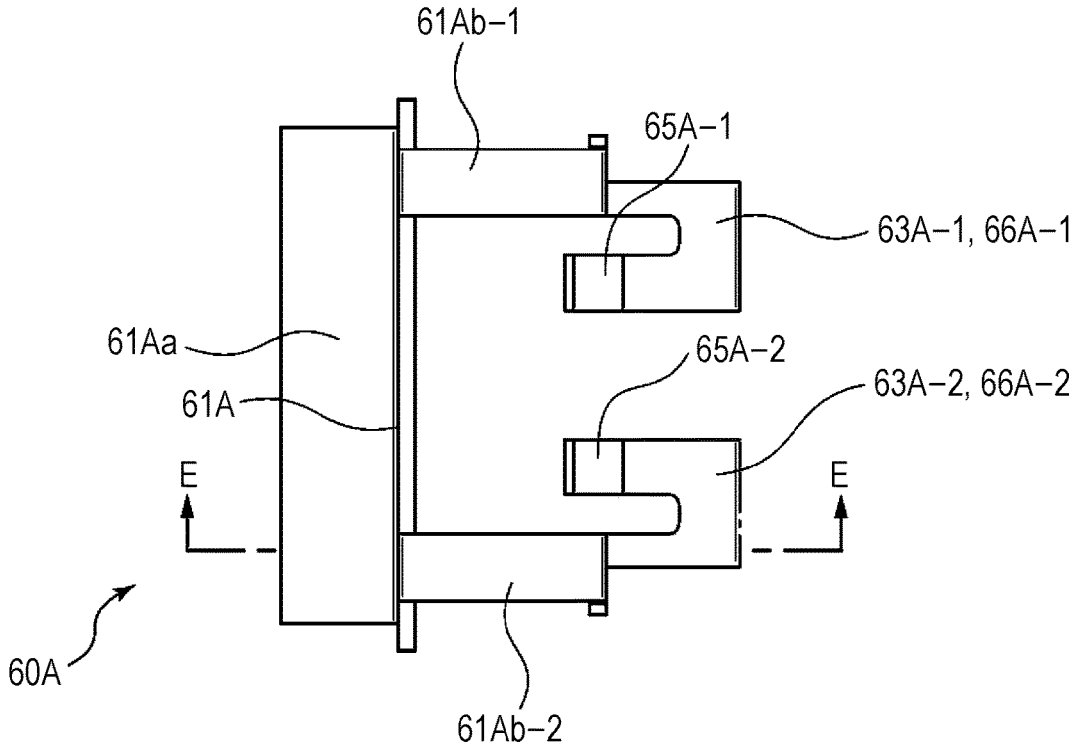
FIGS. 12A and 12B are views showing the plug connector and the receptacle connector used in the second embodiment of the present disclosure after these connectors have been fitted to each other.
Figure 12B:
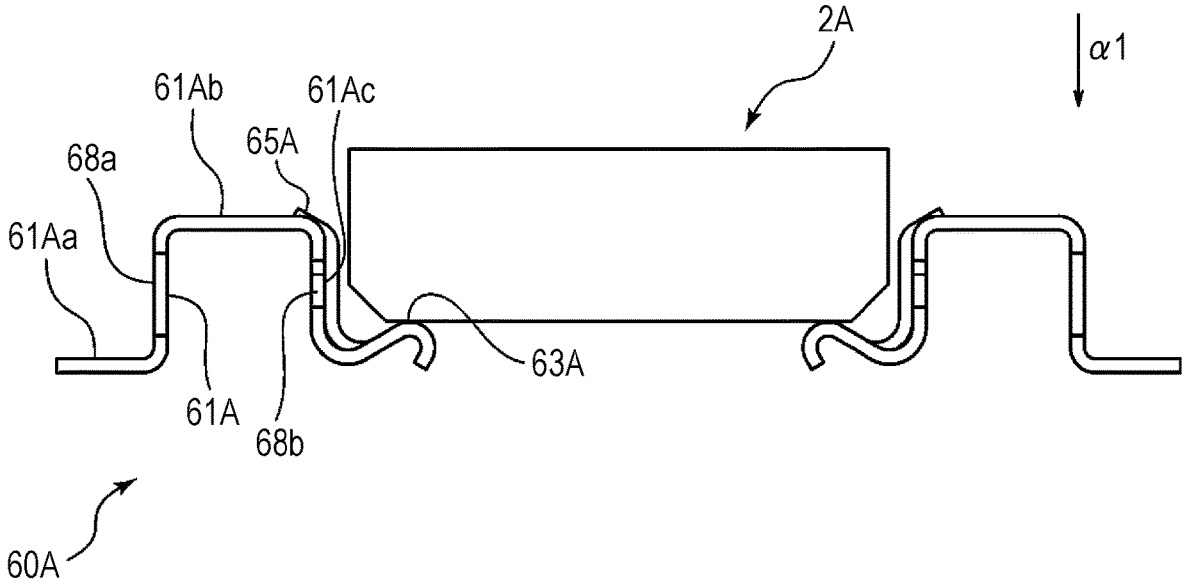

On the other hand, FIG. 12A shows the state of FIG. 9. That is, FIG. 12A is a plan view of the observation member 60A after fitting between the plug connector 2A and the receptacle connector 4A, i.e., after connection among the plug terminals 30A and the receptacle terminals 50A. FIG. 12B is an E-E sectional view of FIG. 12A.

As described above, the observation member 60A is formed from a single piece of metal plate having elasticity. Thus, the observation portions 65A-1, 65A-2 are each coupled to the contact portions 63A-1, 63A-2. When the state of FIGS. 11A and 11B changes to the state of FIGS. 12A and 12B, i.e., when the plug connector 2A and the receptacle connector 4A are fitted to each other and the plug terminals 30A and the receptacle terminals 50A are connected to each other, the contact portions 63A-1, 63A-2 move in contact with part of the receptacle connector 4A. More specifically, the contact portions 63A-1, 63A-2 are pushed to a bottom side along the connection direction "α1." In response to such movement of the contact portions 63A-1, 63A-2, the positions of the observation portions 65A-1, 65A-2 with respect to the receptacle connector 4A change from positions shown in FIGS. 11A and 11B to positions shown in FIGS. 12A and 12B. Further, the observation portions 65A-1, 65A-2 are pushed upwardly, and at the same time, are drawn to the center side of the receptacle connector 4A. As described above, the observation portion 65A can be, as shown in FIG. 8, observed specifically through an observation window 45A from the outside of the receptacle connector 4A at least either one of before or after connection among the plug terminals 30A and the receptacle terminals 50A, i.e., before connection in this embodiment as in the first embodiment. However, in response to movement of the contact portions 63A-1, 63A-2, the positions of the observation portions 65A-1, 65A-2 with respect to the receptacle connector 4A change in the longitudinal direction "β," for example. Accordingly, as shown in FIG. 9, the observation portions 65A-1, 65A-2 are out of sight from the observation windows 45A, i.e., from a predetermined position outside the receptacle connector 4A. Thus, the observation portions 65A-1, 65A-2 cannot be observed.

Third Embodiment

A third embodiment will be described with reference to FIGS. 13 to 17.

Figure 13:
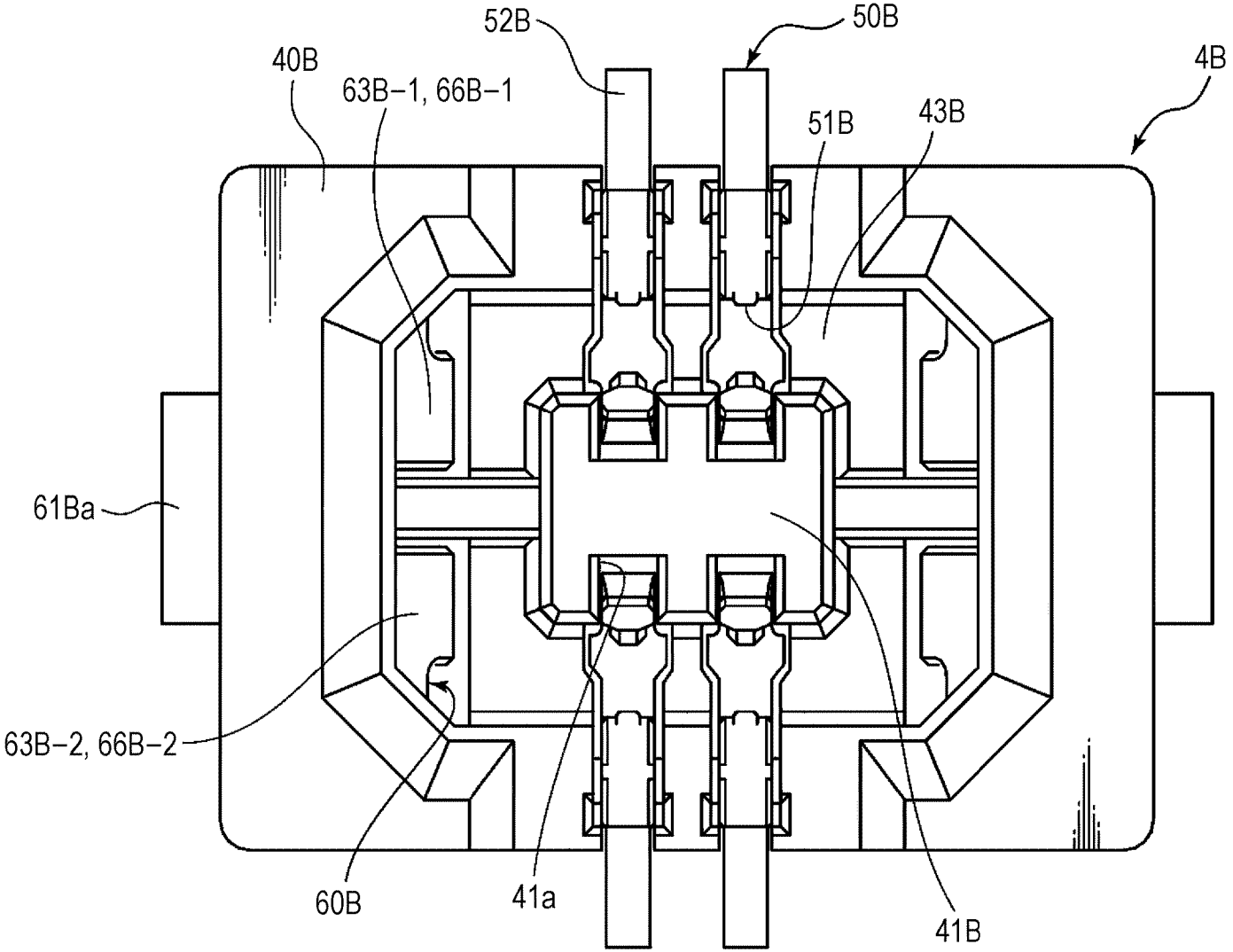
FIG. 13 is a plan view of a receptacle connector according to a third embodiment of the present disclosure.
Figure 14:
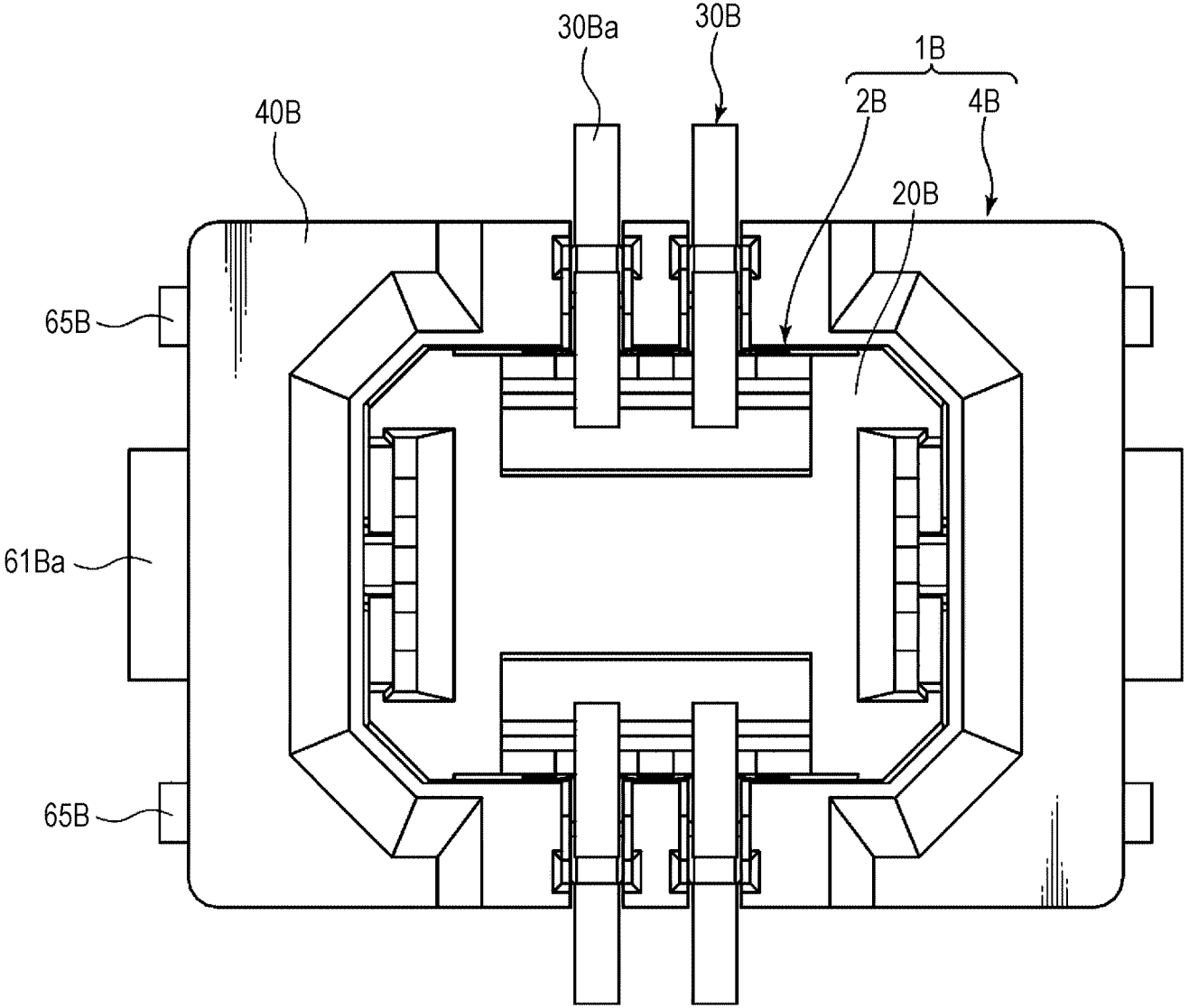
FIG. 14 is a plan view showing a plug connector and the receptacle connector according to the third embodiment of the present disclosure after these connectors have been fitted to each other.
Figure 15A:
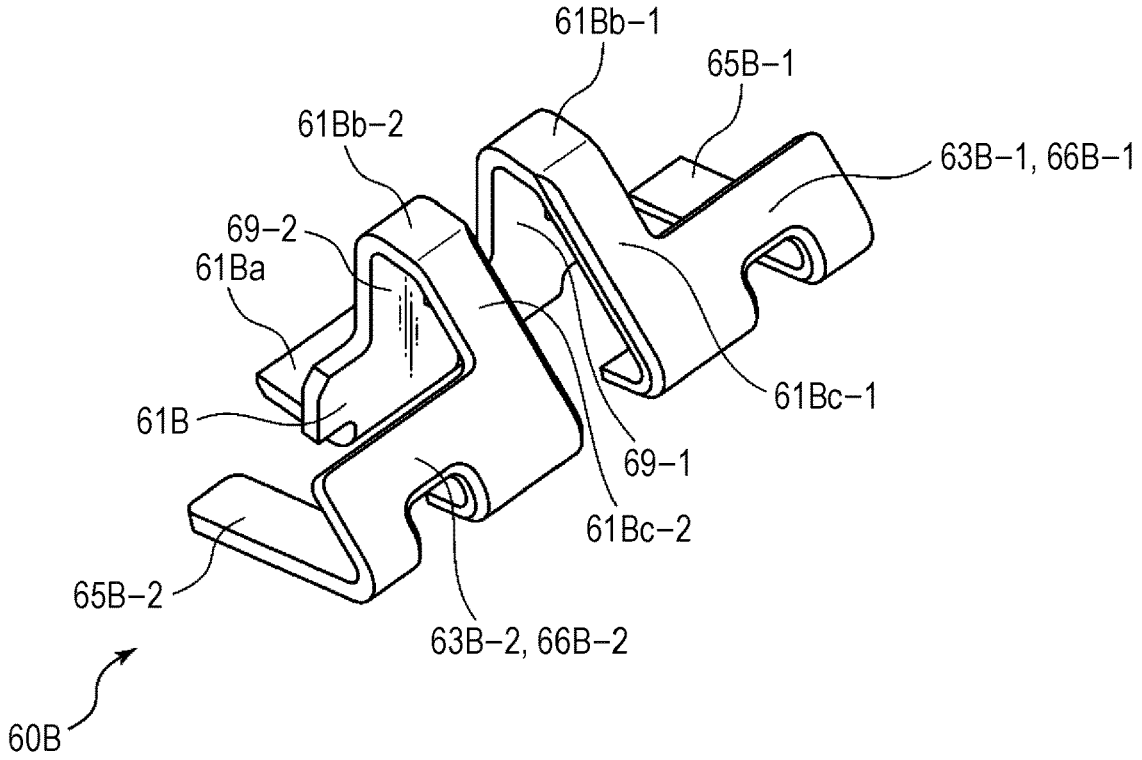
FIGS. 15A and 15B are perspective views of an observation member used in the third embodiment of the present disclosure.
Figure 15B:
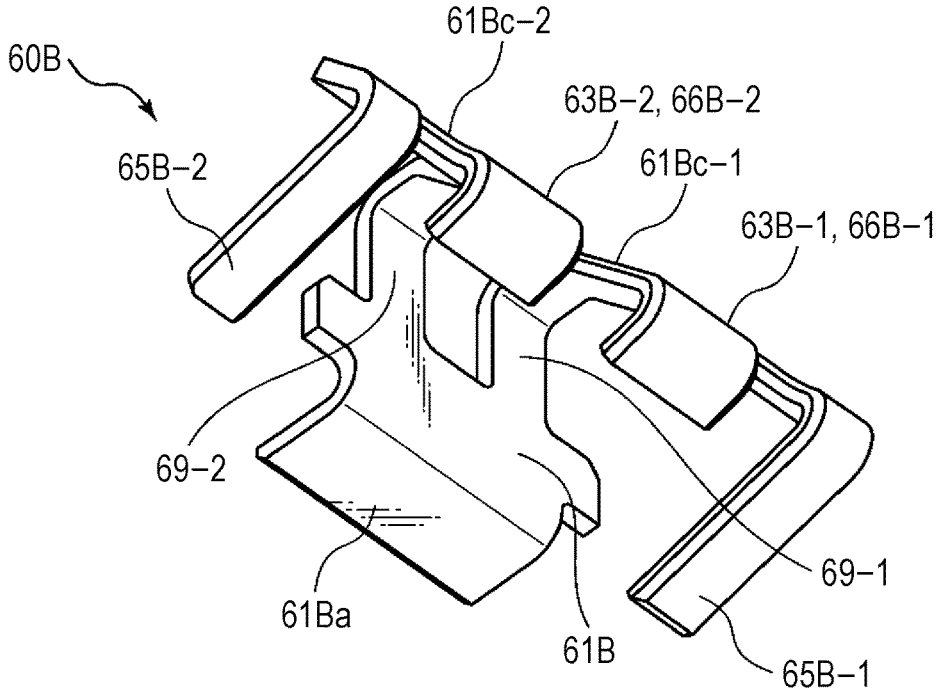

FIG. 13 is a plan view of a receptacle connector 4B. FIG. 14 is a plan view showing a plug connector 2B and the receptacle connector 4B after these connectors have been fitted to each other. FIGS. 15A and 15B are perspective views of an observation member 60B. FIG. 15A is the perspective view of the observation member 60B from above. FIG. 15B is the perspective view of the observation member 60B from below. FIGS. 13 to 15B each correspond to FIG. 3, FIG. 2, FIG. 5A, and FIG. 5B in the first embodiment.

Main differences between the third embodiment and the first embodiment are the method for attaching the observation member 60B to a receptacle housing 40B and the shape of the observation member 60B. It can be assumed that the attachment method is similar to that in the second embodiment. A basic motion principle of the observation member 60B is similar to those of the first embodiment and the second embodiment. Note that the form of motion is slightly different from those in the first embodiment and the second embodiment. Hereinafter, only the main differences from the first embodiment and the second embodiment will be described. Note that the same reference numerals as those of the first embodiment are used with a character "B" to represent members corresponding to those of the first embodiment. Moreover, detailed description thereof will be omitted.

The observation member 60B mainly includes a base 61B, intermediate coupling portions 69 (69-1, 69-2) extending upwardly, upper coupling portions 61Bb (61Bb-1, 61Bb-2), intermediate coupling portions 61Bc (61Bc-1, 61Bc-2) extending downwardly, contact portions 63B (63B-1, 63B-2), and observation portions 65B (65B-1, 65B-2). The observation member 60B is press-fitted and fixed to the receptacle housing 40B. When the observation member 60B is fixed to the receptacle housing 40B, only the contact portions 63B (63B-1, 63B-2) and the observation portions 65B (65B-1, 65B-2) may be mainly exposed to the outside.

The base 61B is a larger plate-shaped body than other portions, the base 61B being arranged on each of end portions of the receptacle connector 4B in the longitudinal direction "β." The base 61B extends widely along the transverse direction "γ," and stands from a mounting portion 61Ba along the "α" direction.

Two intermediate coupling portions 69-1, 69-2 are provided continuously to the base 61B. Further, two upper coupling portions 61Bb-1, 61Bb-2 are provided. These upper coupling portions are each coupled to two intermediate coupling portions 69-1, 69-2. The intermediate coupling portions 69-1, 69-2 and the upper coupling portions 61Bb-1, 61Bb-2 are all incorporated into the receptacle housing 40B as in the base 61B.

Further, the intermediate coupling portions 61Bc-1, 61Bc-2 are provided. These intermediate coupling portions are each formed continuously to the upper coupling portions 61Bb-1, 61Bb-2, and are bent downward of a top side along the "α" direction along the connection direction. At each of end portions of the intermediate coupling portions 61Bc-1, 61Bc-2, the contact portion 63B-1, 63B-2 and the observation portion 65B (65B-1, 65B-2) are provided in this order. The contact portions 63B-1, 63B-2 are formed widely in the transverse direction "γ." The contact portions 63B-1, 63B-2 as described herein have a function as the elastic coupling portion (66) in the first embodiment.

The contact portions 63B-1, 63B-2 are each provided as elastic pieces at the end portions of the intermediate coupling portions 61Bc-1, 61Bc-2. Thus, these contact portions are apart from each other in the transverse direction "γ." The contact portions 63B-1, 63B-2 can contact at least part of the plug connector 2B inserted into a fitting recessed portion 43B of the receptacle connector 4A. By such contact, the contact portions 63B-1, 63B-2 are movable relative to the receptacle connector 4B.

Each of the observation portions 65B-1, 65B-2 is formed at an end portion of a piece extending outward of the receptacle housing 40B along the longitudinal direction "β." These pieces are each provided continuously from the contact portions 63B-1, 63B-2. Thus, these pieces are apart from each other in the transverse direction "γ." The observation portions 65B-1, 65B-2 according to the third embodiment are in a flat plate shape for adjustment of an observation state.

Motion of the observation portions 65B-1, 65B-2 will be described based on the structures of the contact portions 63B-1, 63B-2 and the observation portions 65B-1, 65B-2 with reference to FIGS. 16 and 17. These figures each correspond to FIGS. 6A and 6B and FIGS. 7A and 7B in the first embodiment.

Figure 16:
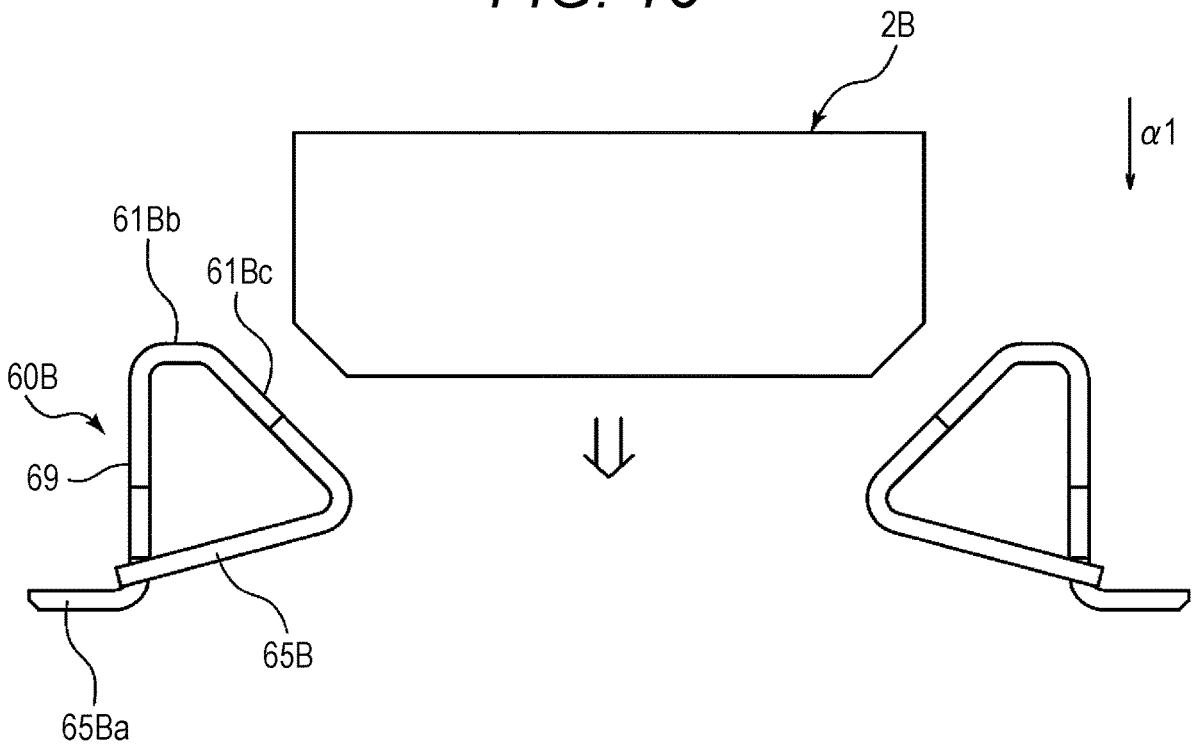
FIG. 16 is a view showing the plug connector and the receptacle connector used in the third embodiment of the present disclosure before these connectors are fitted to each other.

FIG. 16 shows the state of FIG. 13. That is, FIG. 16 is a plan view showing the observation member 60B before fitting between the plug connector 2B and the receptacle connector 4B, i.e., before connection among plug terminals 30B and receptacle terminals 50B.

Figure 17:
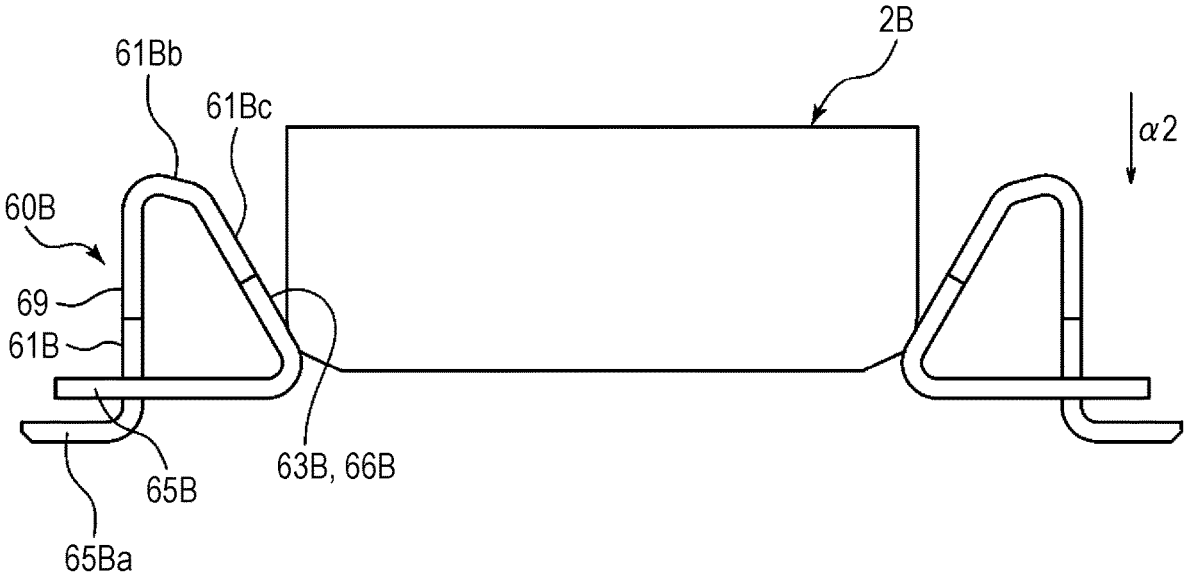
FIG. 17 is a view showing the plug connector and the receptacle connector used in the third embodiment of the present disclosure after these connectors have been fitted to each other.

On the other hand, FIG. 17 shows the state of FIG. 14. That is, FIG. 17 is a plan view showing the observation member 60B after fitting between the plug connector 2B and the receptacle connector 4B, i.e., after connection among the plug terminals 30B and the receptacle terminals 50B.

As described above, the observation member 60B is formed from a single piece of metal plate having elasticity. Thus, the observation portions 65B-1, 65B-2 are each coupled to the contact portions 63B-1, 63B-2. When the state of FIG. 16 changes to the state of FIG. 17, i.e., when the plug connector 2B and the receptacle connector 4B are fitted to each other and the plug terminals 30B and the receptacle terminals 50B are connected to each other, the contact portions 63B-1, 63B-2 move in contact with part of the receptacle connector 4B. More specifically, the contact portions 63B-1, 63B-2 are pushed to a bottom side along the connection direction "α1." In response to such movement of the contact portions 63B-1, 63B-2, the positions of the observation portions 65B-1, 65B-2 with respect to the receptacle connector 4B change from the state shown in FIG. 16 to the state shown in FIG. 17. Further, the observation portions 65B-1, 65B-2 are pushed upwardly, and at the same time, are pushed to a side opposite to the center side of the receptacle connector 4B. As described above, as shown in FIG. 16, the observation portions 65B-1, 65B-2 cannot be, unlike the first embodiment and the second embodiment, observed from the outside of the receptacle connector 4B at least either one of before or after connection among the plug terminals 30B and the receptacle terminals 50B, i.e., before connection in this embodiment. However, in response to movement of the contact portions 63B-1, 63B-2, the positions of the observation portions 65B-1, 65B-2 with respect to the receptacle connector 4B change in the longitudinal direction "β," for example. Accordingly, as shown in FIG. 17, the observation portions 65B-1, 65B-2 protrude from predetermined positions outside the receptacle housing 40B, and can be observed.

<Image Checking System>

Figure 18:
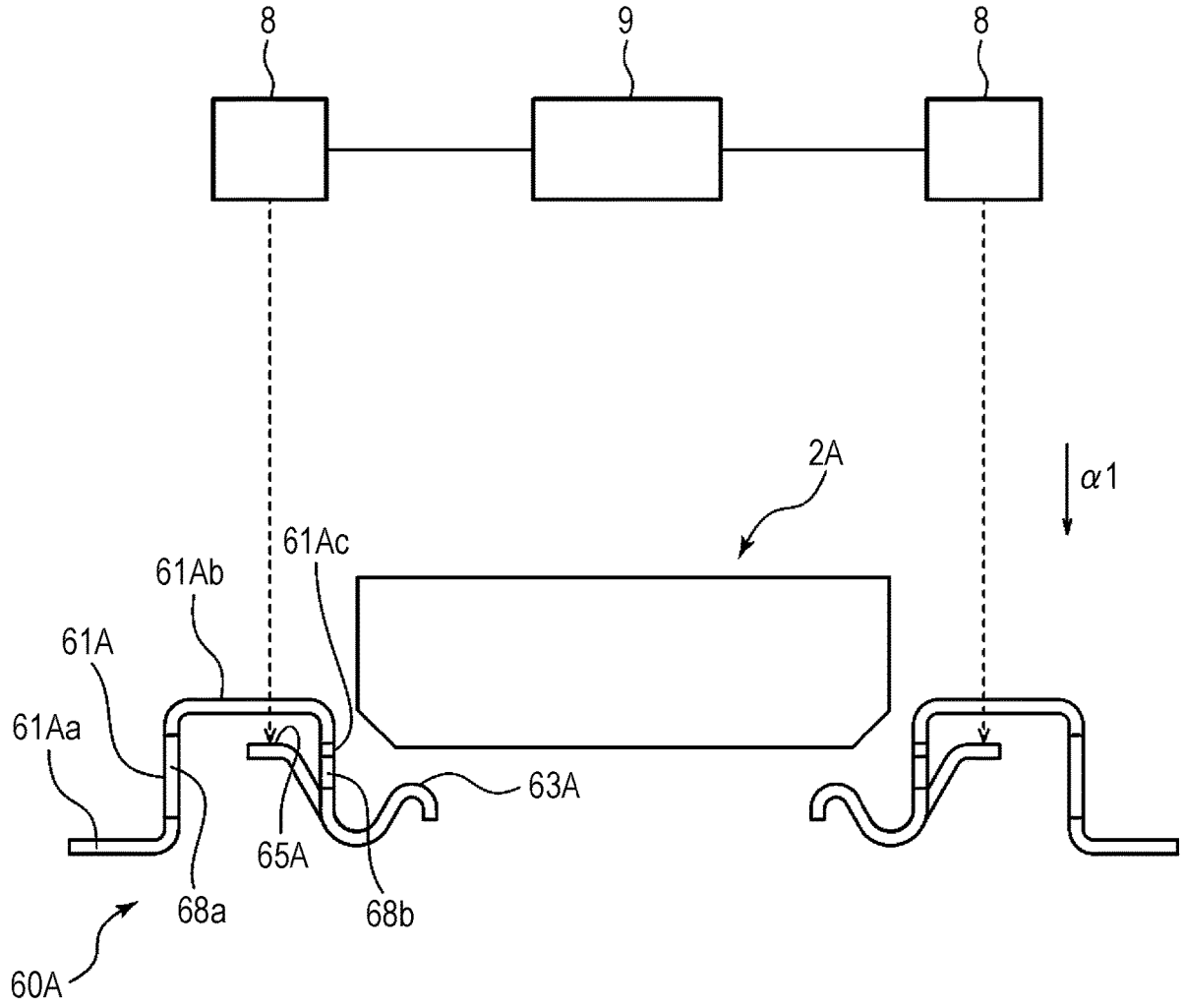
FIG. 18 is a schematic view showing one example of an image checking system used in a preferred embodiment of the present disclosure.

FIG. 18 schematically shows one example of an image checking system according to a preferred embodiment of the present disclosure. For the sake of convenience, one example of an image checking system utilizing a connector device 1A according to the second embodiment shown in FIGS. 8 to 12B will be specifically described herein with reference to FIG. 11B. Note that needless to say, the system may be formed using a connector device other than that in the second embodiment. Note that as in FIG. 11B, FIG. 18 does not show the receptacle connector 4A and the like for the sake of convenience.

The image checking system includes at least an image sensing unit 8 formed utilizing a camera and the like and a determination unit 9 formed utilizing a computer processing device (a CPU). For determination by the determination unit 9, software available commercially as image processing software can be also used.

The image sensing unit 8 is, for example, fixed to a predetermined position above the observation window 45A (see FIGS. 8 and 9) of the receptacle connector 4A by means of some kind of fixing section (not shown). The observation portions 65A (65A-1, 65A-2) provided inside the receptacle connector 4A can be, for example, observed in the "α1" direction through each observation window 45A.

The determination unit 9 determines connection among the plug terminals 30A and the receptacle terminals 50A based on a change in the observation state sensed by the image sensing unit 8. The change in the observation state is instructed by each of the multiple observation portions 65A (65A-1, 65A-2), i.e., the total of four observation portions 65A (65A-1, 65A-2) in this case, which is visible through the observation windows 45A. The image sensing unit 8 can sense the change in the observation state of each of all observation portions 65A.

The change in the observation state can be also taken as a change between two states shown in FIGS. 8 and 9, i.e., a change between a state in which the observation portion 65A is visible through the observation window 45A and a state in which the observation portion 65A is not visible at all through the observation window 45A. Note that the change in the observation state may be taken from the state shown in FIG. 8. Such an observation state change includes, for example, a change in the degree of visibility of the observation portion 65A and a change in the shape of the observation portion 65A from the state in which the observation portion 65A is visible through the observation window 45A. Further, a comparison result of the change in the observation state of each of the multiple observation portions 65A may be also taken as the change in the observation state. In this case, inclination of the plug connector 2A with respect to the receptacle connector 4A can be also sequentially grasped. By detailed analysis of the change in the observation state, a determination result by the determination unit 9 can include not only a mere result such as the presence or absence of connection but also the location or degree of a connection failure, for example.

As described above, according to the present disclosure, completion of fitting can be visibly checked. Thus, completion of fitting can be intuitively, directly, easily, and reliably checked utilizing image sensing.

Note that the present embodiment is not limited to the above-described embodiments. Various other changes can be made to the above-described embodiments.

For example, in the present embodiment, part of the plug connector inserted into the fitting recessed portion of the receptacle connector contacts the contact portions. Note that another portion of the plug connector may contact the contact portions to change the observation state. It is enough that the observation state is changed by contact of any portion of the plug connector with the contact portions.

Moreover, in the above-described embodiments, the change in the observation state is sensed utilizing a relative positional change of the observation portion. Note that it is enough that the observation state can be changed in response to contact of the contact portions. Thus, the change in the observation state is not limited to that according to the position, but the observation state may change according to at least any one of a size, a shape, a pattern, or a color. Alternatively, the change in the observation state can be also made by an electrical or chemical change in addition to mechanical and structural changes. Further, the shape of the observation portion is not necessarily the mere rectangular shape, but may be a triangular shape. Further, the pattern or the color may be added so that the change in the observation state can be easily identified.

Further, the observation portion may be observable before connection among the terminals as described in the first and second embodiments, or may be observable after connection among the terminals as described in the third embodiment. Further, the observation portion may be observable both of before and after connection among the terminals. This is because the observation state can change in response to contact of the contact portion even in a case where the observation portion is observable both of before and after connection among the terminals and the terminal connection state can be checked if the user can recognize such an observation state change. Thus, it is enough that the observation portion is provided observable at least one of before or after connection among the terminals.

Further, in the present embodiment, the observation portions are provided at two end portions in the longitudinal direction. Note that the observation portion may be provided only at one end portion. Note that the observation portions are provided at two end portions so that terminal connection can be more accurately checked.

In addition, in the present embodiment, two observation portions are apart from each other in the transverse direction. Note that two observation portions are not necessarily provided. Only one observation portion may be provided. Note that in a case where at least two observation portions are provided, even if the plug connector 2 inclines to a certain extent with respect to the receptacle connector 4 when the receptacle connector 4 is fitted in the plug connector 2, such inclination can be easily identified and corrected.

Moreover, in the present embodiment, a portion contacting the contact portion is the reinforcing metal fitting. Note that any portion of the partner connector may contact the contact portion as long as such contact is associated with connection between the contact portion and the terminal.

The preferred embodiments have been described above. Note that it should be understood that these embodiments are merely representative examples of a product and the method for manufacturing the product. It can be recognized that modification and correction from these preferred embodiments to different embodiments are obvious to those skilled in the art in light of teaching described above. Thus, other exemplary embodiments and representative embodiments can be made without departing from the spirit of the subject matter of the present invention.

What is claimed is:

1. A connector device comprising:

a first connector; and a second connector, wherein the first connector includes a first housing and a first terminal provided in the first housing, the second connector includes a second housing and a second terminal and an observation member provided in the second housing, the first connector and the second connector are configured such that when at least part of the first connector is inserted into a predetermined portion of the second housing, the first terminal and the second terminal are connected to each other, the observation member includes a contact portion and an observation portion, the contact portion is configured to contact the first connector when the at least part of the first connector is inserted into the predetermined portion of the second housing, and the observation portion is provided observable from an outside of the second connector at least either one of before or after connection between the first terminal and the second terminal, and is configured such that an observation state of the observation portion from the outside of the second connector changes in response to contact between the first connector and the contact portion.

2. The connector device according to claim 1, wherein the observation state of the observation portion from the outside of the second connector changes such that the observation portion is observable from the outside of the second connector before the connection and is not observable from the outside of the second connector in response to the contact.

3. The connector device according to claim 1, wherein the observation state of the observation portion from the outside of the second connector changes such that the observation portion is not observable from the outside of the second connector before the connection and is observable from the outside of the second connector in response to the contact.

4. The connector device according to claim 1, wherein a change in the observation state includes a change in at least any one of a position, a size, a shape, a pattern, or a color of the observation portion.

5. The connector device according to claim 4, wherein it is configured such that a position of the observation portion with respect to the second connector changes in response to the contact.

6. The connector device according to claim 5, wherein the contact portion and the observation portion are coupled to each other.

7. The connector device according to claim 5, wherein it is configured such that the contact portion is movable relative to the second connector by the contact, and the position of the observation portion with respect to the second connector changes in response to movement of the contact portion.

8. The connector device according to claim 5, wherein it is configured such that the position of the observation portion with respect to the second connector changes at least in a longitudinal direction of the second housing perpendicular to a direction of connection between the first connector and the second connector.

9. The connector device according to claim 5, wherein the contact portion is arranged between the observation portion and the second terminal in a longitudinal direction of the second housing.

10. The connector device according to claim 1, wherein the observation portion includes at least two observation portions provided at at least one end portion in a longitudinal direction of the second housing perpendicular to a direction of connection between the first connector and the second connector, and the observation portions are apart from each other in a transverse direction of the second housing perpendicular to the connection direction.

11. The connector device according to claim 1, wherein the observation member is provided at each of all end portions of the second housing in a longitudinal direction of the second housing perpendicular to a direction of connection between the first connector and the second connector.

12. The connector device according to claim 1, wherein the observation member includes an elastic member, and the contact portion includes an elastic piece as part of the elastic member.

13. The connector device according to claim 1, wherein the observation member further includes a mounting portion and a covering portion covering a peripheral wall of the first housing.

14. A system comprising:

a connector device;

an image sensing unit; and a determination unit, wherein the connector device includes a first connector and a second connector, the first connector includes a first housing and a first terminal provided in the first housing, the second connector includes a second housing and a second terminal and an observation member provided in the second housing, the first connector and the second connector are configured such that when at least part of the first connector is inserted into a predetermined portion of the second housing, the first terminal and the second terminal are connected to each other, the observation member includes a contact portion and an observation portion, the contact portion is configured to contact the first connector when the at least part of the first connector is inserted into the predetermined portion of the second housing, the observation portion is provided observable from an outside of the second connector at least either one of before or after connection between the first terminal and the second terminal, and is configured such that an observation state of the observation portion from the outside of the second connector changes in response to contact between the first connector and the contact portion, the image sensing unit is configured to sense a change in the observation state through an image, and the determination unit is configured to determine connection between the first terminal and the second terminal based on the observation state change sensed by the image sensing unit.

15. The system according to claim 14, wherein the observation state of the observation portion from the outside of the second connector changes such that the observation portion is observable from the outside of the second connector before the connection and is not observable from the outside of the second connector in response to the contact.

16. The system according to claim 14, wherein the observation state of the observation portion from the outside of the second connector changes such that the observation portion is not observable from the outside of the second connector before the connection and is observable from the outside of the second connector in response to the contact.

17. A method comprising:

a connection step;

a sensing step; and a determination step, wherein at the connection step, a first connector and a second connector included in a connector device are connected to each other, the first connector includes a first housing and a first terminal provided in the first housing, the second connector includes a second housing and a second terminal and an observation member provided in the second housing, the first connector and the second connector are configured such that when at least part of the first connector is inserted into a predetermined portion of the second housing, the first terminal and the second terminal are connected to each other, the observation member includes a contact portion and an observation portion, the contact portion is configured to contact the first connector when the at least part of the first connector is inserted into the predetermined portion of the second housing, the observation portion is provided observable from an outside of the second connector at least either one of before or after connection between the first terminal and the second terminal, and is configured such that an observation state of the observation portion from the outside of the second connector changes in response to contact between the first connector and the contact portion, at the sensing step, a change in the observation state is sensed through an image, and at the determination step, connection between the first terminal and the second terminal is determined based on the sensed observation state change.

18. The method according to claim 17, wherein the observation state of the observation portion from the outside of the second connector changes such that the observation portion is observable from the outside of the second connector before the connection and is not observable from the outside of the second connector in response to the contact.

19. The method according to claim 17, wherein the observation state of the observation portion from the outside of the second connector changes such that the observation portion is not observable from the outside of the second connector before the connection and is observable from the outside of the second connector in response to the contact.

* * * * *